United States Patent [19]

Hoffmann

[11] 4,104,845

[45] Aug. 8, 1978

[54] METHOD AND APPARATUS FOR APPLYING SLEEVES TO NECKS OF BOTTLES AND OTHER CONTAINERS

[75] Inventor: Wolfgang Hoffmann, Modesto, Calif.

[73] Assignee: B & H Manufacturing Company, Inc., Ceres, Calif.

[21] Appl. No.: 690,943

[22] Filed: May 28, 1976

Related U.S. Application Data

[63] Continuation-in-part of Ser. No. 471,965, May 21, 1974, abandoned.

[51] Int. Cl.[2] ..... B65B 21/24; B67B 5/00

[52] U.S. Cl. ..... 53/14; 53/41; 53/49; 53/297

[58] Field of Search ..... 53/290, 14, 291, 292, 53/293, 294, 295, 296, 297, 49, 170, 41, 42, 139.3, 334, 196, 287, 373, 198 R, 329

[56] References Cited

U.S. PATENT DOCUMENTS

| | | | |
|---|---|---|---|
| 1,245,952 | 11/1917 | Nichols | 53/49 |
| 2,109,505 | 3/1938 | Rue et al. | 53/49 |
| 2,579,458 | 12/1951 | Allen et al. | 53/292 |
| 2,630,956 | 3/1953 | Pomeroy et al. | 53/292 |
| 2,771,725 | 11/1956 | Carter | 53/41 |
| 2,835,088 | 5/1958 | Eddison et al. | 53/291 X |
| 2,846,835 | 8/1958 | Anguilar et al. | 53/291 |
| 2,867,956 | 1/1959 | Murrell | 53/296 |
| 2,994,172 | 8/1961 | Shields | 53/329 |
| 3,336,728 | 8/1967 | Monaco | 53/334 |
| 3,457,694 | 7/1969 | Tatibana | 53/373 X |
| 3,888,067 | 6/1975 | Cross et al. | 53/292 |
| 3,910,013 | 10/1975 | Babineau | 53/291 |
| 3,924,387 | 12/1975 | Konstantin | 53/291 |

FOREIGN PATENT DOCUMENTS

| | | | |
|---|---|---|---|
| 158,963 | 6/1940 | Fed. Rep. of Germany | 53/49 F |

*Primary Examiner*—Horace M. Culver
*Attorney, Agent, or Firm*—Edward B. Gregg

[57] ABSTRACT

Tubular sleeves are formed by continuously supplying a continuous web of sheet material to a cutter, cutting individual sleeves in succession from the web, forming each severed sleeve into a cylindrical tube by attaching one end of the sleeve to a rotating mandrel by means of suction, spinning the mandrel with the sleeve attached thereto so as to wrap the sleeve around the mandrel and form a tube, slipping the tube off of the mandrel and onto the neck of a container and then conforming the sleeve to the shape of the neck as by mechanical means or by heat-shrinking.

34 Claims, 32 Drawing Figures

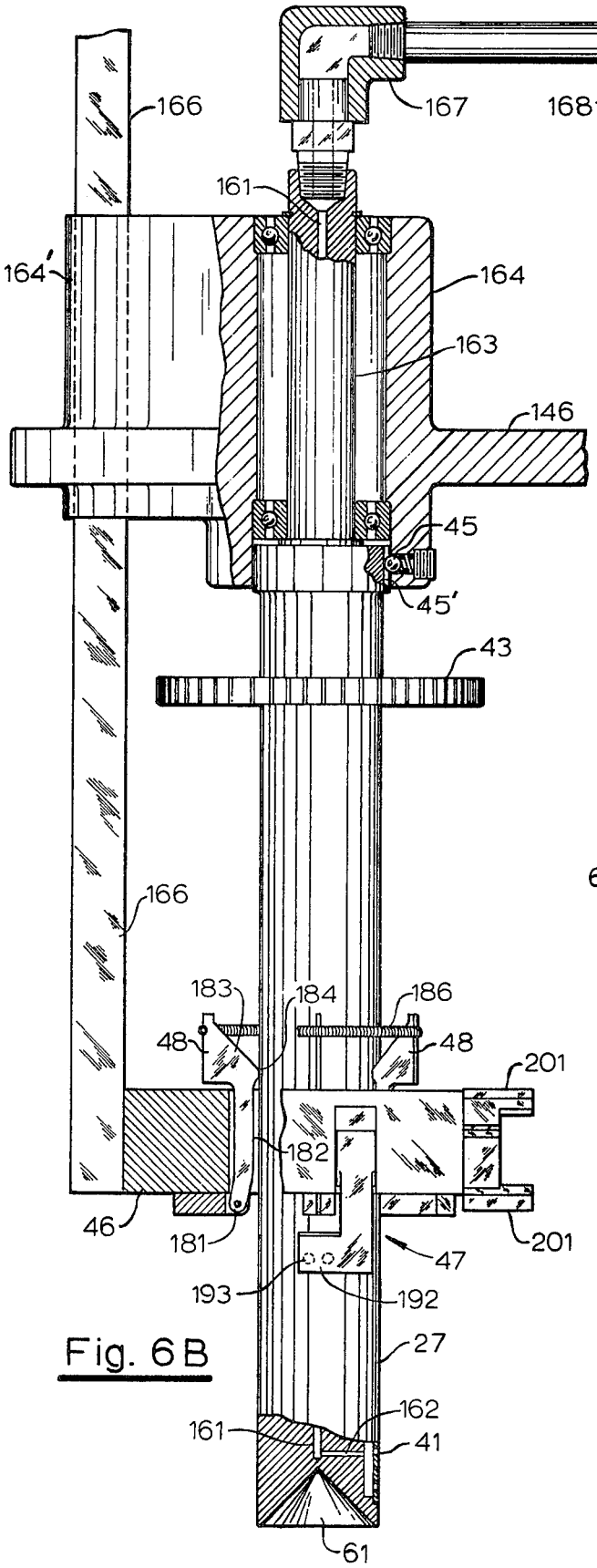
Fig. 6B
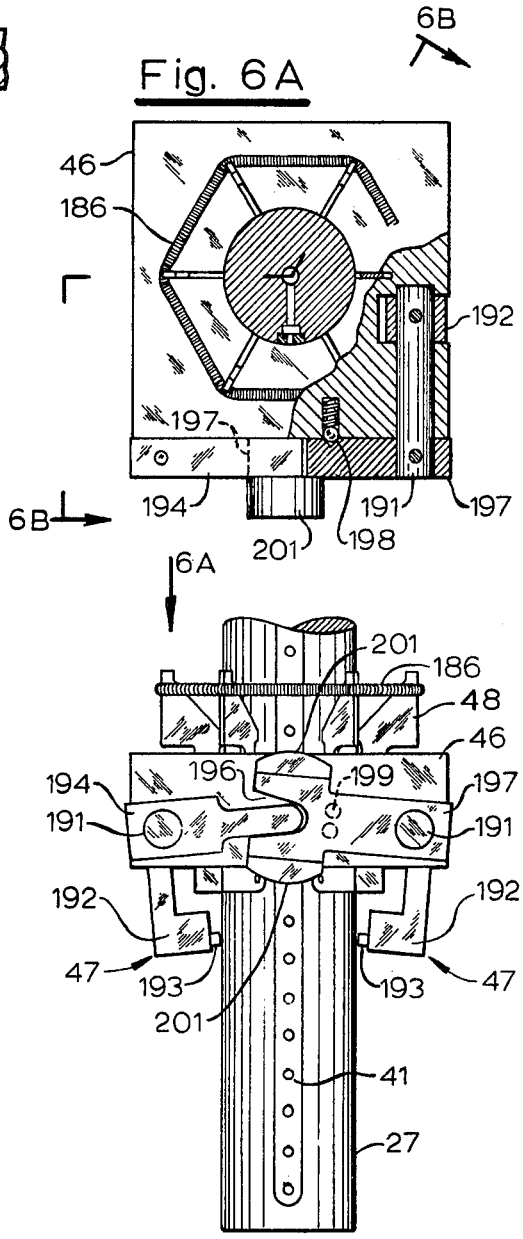
Fig. 6A
Fig. 6

Fig. 7D
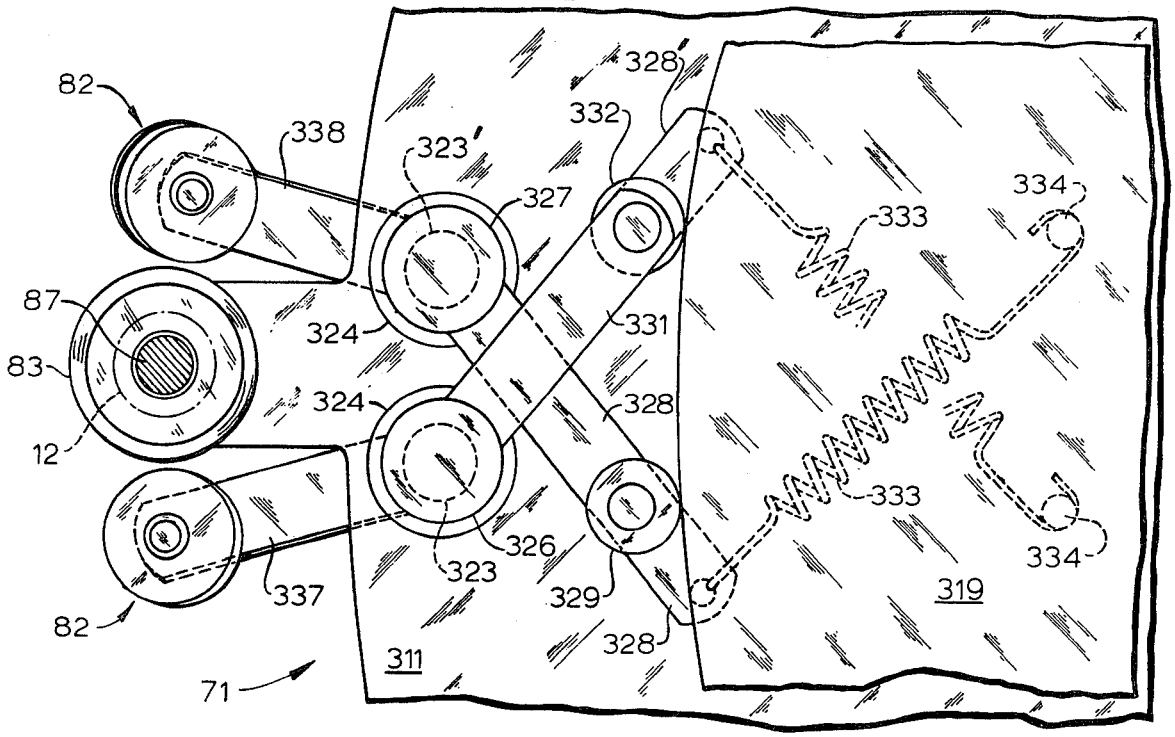
Fig. 7A
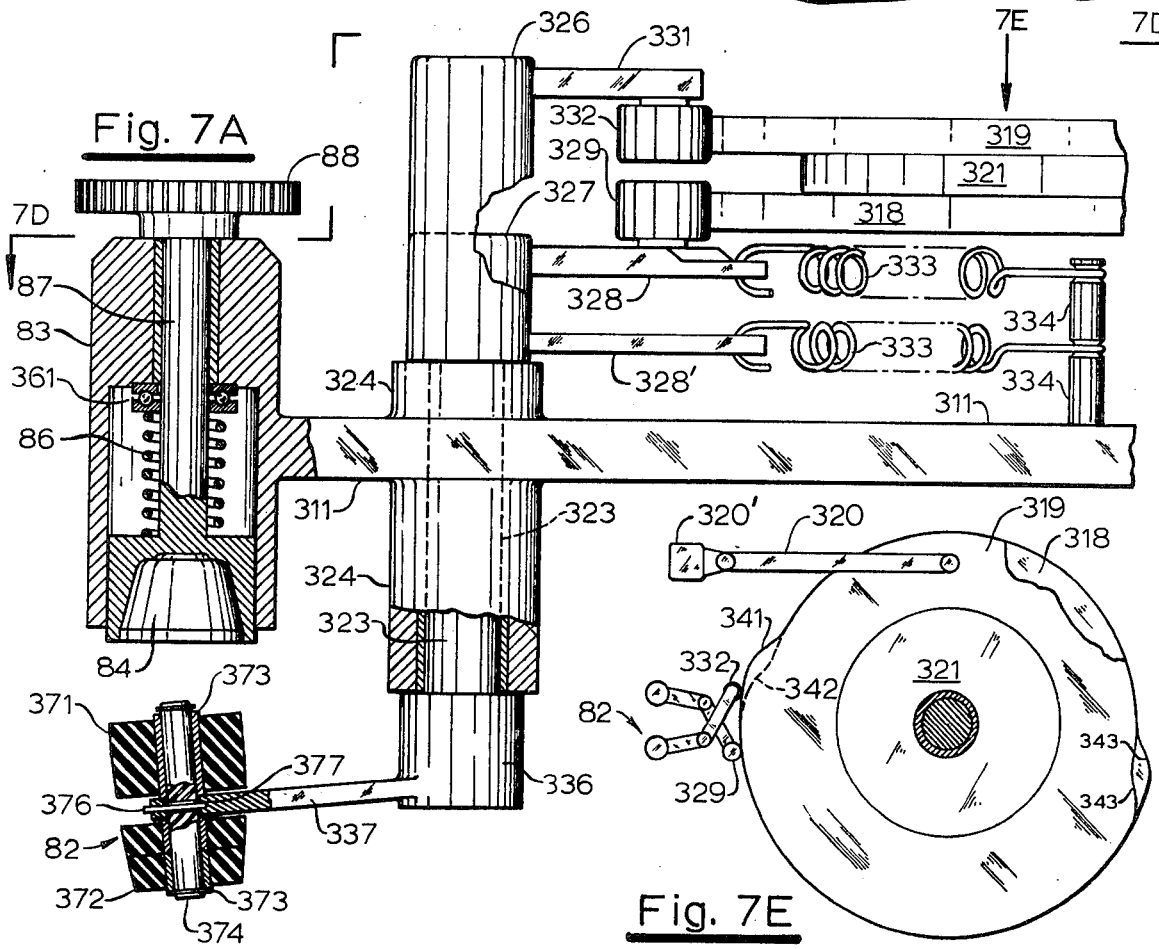
Fig. 7E

METHOD AND APPARATUS FOR APPLYING SLEEVES TO NECKS OF BOTTLES AND OTHER CONTAINERS

This application is a continuation-in-part of Hoffmann, Ser. No. 471,965, filed May 21, 1974, and now abandoned, entitled "BOTTLE CAPPING METHOD AND APPARATUS".

The invention is concerned with the problem of applying sleeves to containers which are non-cylindrical in shape, such as the tapered necks of bottles or necks or containers which depart in some other respect from a cylindrical configuration, for example necks which contain ribs, screw threads or the like. Such departure from cylindrical shape interfers with, or makes it impossible to adhering one end of a sleeve to a container and then by rotating the container wrap the sleeve around it. An example of this wrap around technique is described and claimed in my U.S. Pat. No. 3,834,963.

One method used heretofore to apply sleeves to non-cylindrical necks of containers, such as the tapered necks of bottles, has been to preform the sleeves in frusto conical shape and then apply them one by one to the containers. This, however, is an expensive procedure and does not lend itself to a continuous operation in which sleeve segments are formed continuously from a continuous web of sleeve material and each severed segment is then applied to the containers.

It is an object of the present invention to provide improved apparatus and method for applying sleeves to non-cylindrical necks of containers.

It is a further and particular object of the present invention to provide method and apparatus for applying sleeves to non-cylindrical necks of containers such as, for example, tapered necks of bottles by means which allow a continuous feed of sleeve material, severing individual sleeve segments in sequence, forming each severed sleeve segment into a tube and then applying the tube to the non-cylindrical neck of a container and shaping the tubular sleeve to the shape of the neck.

The above and other objects of the invention will be apparent from the ensuing description and the appended claims.

Certain forms of the invention are illustrated by way of example in the accompanying drawings in which FIGS. 1 through 9B illustrate apparatus and a method for applying a deadset material such as metal foil to containers such as champagne bottles in which the sleeves are not only shaped to the taper of the necks but are also folded over the tops. FIG. 10 illustrates another embodiment in which there is no fold over feature. FIG. 11 illustrates a heat shrink method of conforming the tubular sleeves to the shape of the neck of the container.

DESCRIPTION OF THE DRAWINGS

FIG. 1 is an isometric view of the cylindrical capping sleeve which is formed;

FIG. 1E illustrates the completely molded sleeve of FIG. 1D on a bottle neck and over the stopper end thereof;

FIG. 6 is a side elevational view of a mandrel, and ring movable axially thereof which carries the aforementioned stripping fingers and creasing blades; the view looking in the direction of arrow 6 in FIG. 5;

FIG. 6A is a plan view, partly in section, looking in the direction of arrow 6A in FIG. 6;

FIG. 6B is a vertical sectional elevation taken in planes indicated by line 6B — 6B in FIG. 6A;

FIG. 7A is an enlarged fragmentary sectional elevation of the molding roller and molding cavity portion shown in FIG. 7;

FIG. 7D is a fragmentary enlarged plan view, partly in section, taken in planes indicated by lines 7D — 7D in FIG. 7A; the stopper end of a bottle being shown in phantom lines;

FIG. 7E is a fragmentary plan view, partially schematic, of a cam actuating mechanism for molding rollers looking in the direction of arrow 7E in FIG. 7A;

DETAILED DESCRIPTION

Figures 1, 1A, 1B, 1C, 1D, 1E:
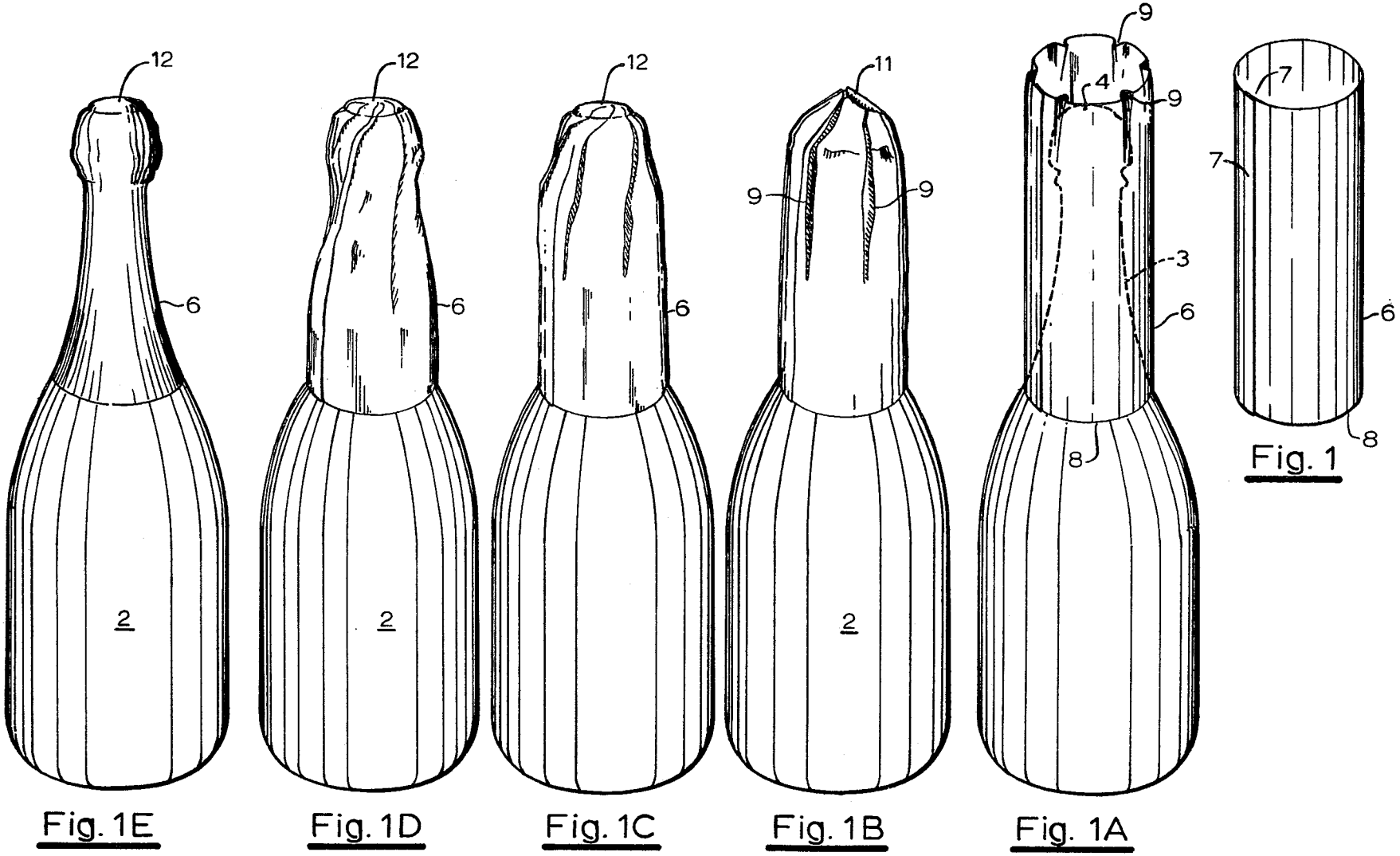
FIGS. 1 through 1E are schematic views illustrating various stages in the preforming and molding of a cylindrical sleeve over the neck and stopper end of a bottle. Reading from right to left.
FIG. 1A illustrates the sleeve in an initial stage of deformation wherein inwardly extending spaced apart longitudinally extending creases are formed.
FIG. 1B illustrates the stage of deformation wherein the creases are completely formed and the top end of the sleeve has been deformed inwardly over the stopper end of the bottle in the form of a pyramid.
FIG. 1C is a further stage wherein the partially preformed sleeve end has been pressed against the stopper end of the bottle.
FIG. 1D illustrates the shape of the sleeve in an initial stage of molding.

With particular reference to FIGS. 2, 2C, 3 and 4, the apparatus comprises essentially three main sections, namely a capping sheet forming section A which severs individual sheets from a parent strip of material; a section B which forms cylindrical sleeves from the respective sheets and preforms them to conform partially to the shape of bottle necks and bends the upper ends of the sleeves inwardly over the stoppered ends of the bottle; and a molding section C wherein the preformed capping sleeves on the necks of the bottles are molded to the shape of the necks and to the stoppered ends of the bottle. The capping method is illustrated in FIGS. 1 through 1E which from right to left depict the various phases of a capping procedure. In this connection, these Figures illustrate a champagne bottle for which the invention has particular applicability but may be employed for the capping of other types of bottles or similar containers.

As is shown in FIG. 1A, the bottle 2 has a generally conically shaped or inwardly tapered neck 3 with a stopper 4 closing the bottle discharge opening. Usually in champagne or the like bottle, stopper 4 is restrained by a wire (not shown) wound about the neck of the bottle, and the stopper has a rounded top. The cap on such type of bottle not only serves as a label in many instances but is for ornamental purposes to hide the restraining wire as well as to present a pleasing appearance. The capping material is generally one which is capable of assuming a dead set condition when creased or folded, such as lead or aluminum foil.

In the invention hereof, the cap is first formed as a cylindrical sleeve 6 from a sheet 6', which has opposite end edges adhesively bonded together as indicated at 7. Successive sleeves are formed in the apparatus in a manner to be described, and slipped over the respective bottle necks. It will be noted that the sleeve is of such length as to extend beyond the top end of the bottle stopper when the lower edge 8 of the sleeve is supported or rests on the body of the bottle as is shown in FIGS. 1A through 1E.

In the first step of the method after formation of the sleeve, it is slipped over a bottle neck. The upper end of the sleeve is then creased inwardly by creasing means to be subsequently described, so that there are multiplicity of such creases 9 extending longitudinally at spaced apart locations about the periphery of the sleeve. This causes the upper end of the sleeve to be partially turned or bent inwardly over the stopper end 4 of the bottle. Creasing is continued further along the length of the sleeve as shown in FIG. 1B; and as is illustrated in such FIG., the top end of the sleeve is deformed into conical pyramidal shape 11 over the stopper end of the bottle. As a result of the creasing and inward bending of the upper end of the sleeve, it becomes preformed partially to the shape of the bottle neck to facilitate subsequent molding of the sleeve completely to the shape of the bottle neck and its stoppered end as will be explained more fully hereinafter.

FIG. 1C illustrates the next phase of the method wherein the conically shaped end of the sleeve is molded fat at 12 in a mold cavity, against the stoppered end of the bottle, to conform completely to the shape of the stoppered end of the bottle. Such end molding of the sleeve is effected by clamping the bottle between a support platform therefor and the mold cavity. The mold cavity and the platform are mounted for rotation so that when the bottle is rotated about its axis, suitably arranged molding rollers yieldably press against the side of the sleeve to compress the creased portion and the remainder of the sleeve, as is illustrated in FIG. 1D which depicts an initial stage of the molding. The rotation is continued to complete the molding as is illustrated in FIG. 1E.

Figure 3:
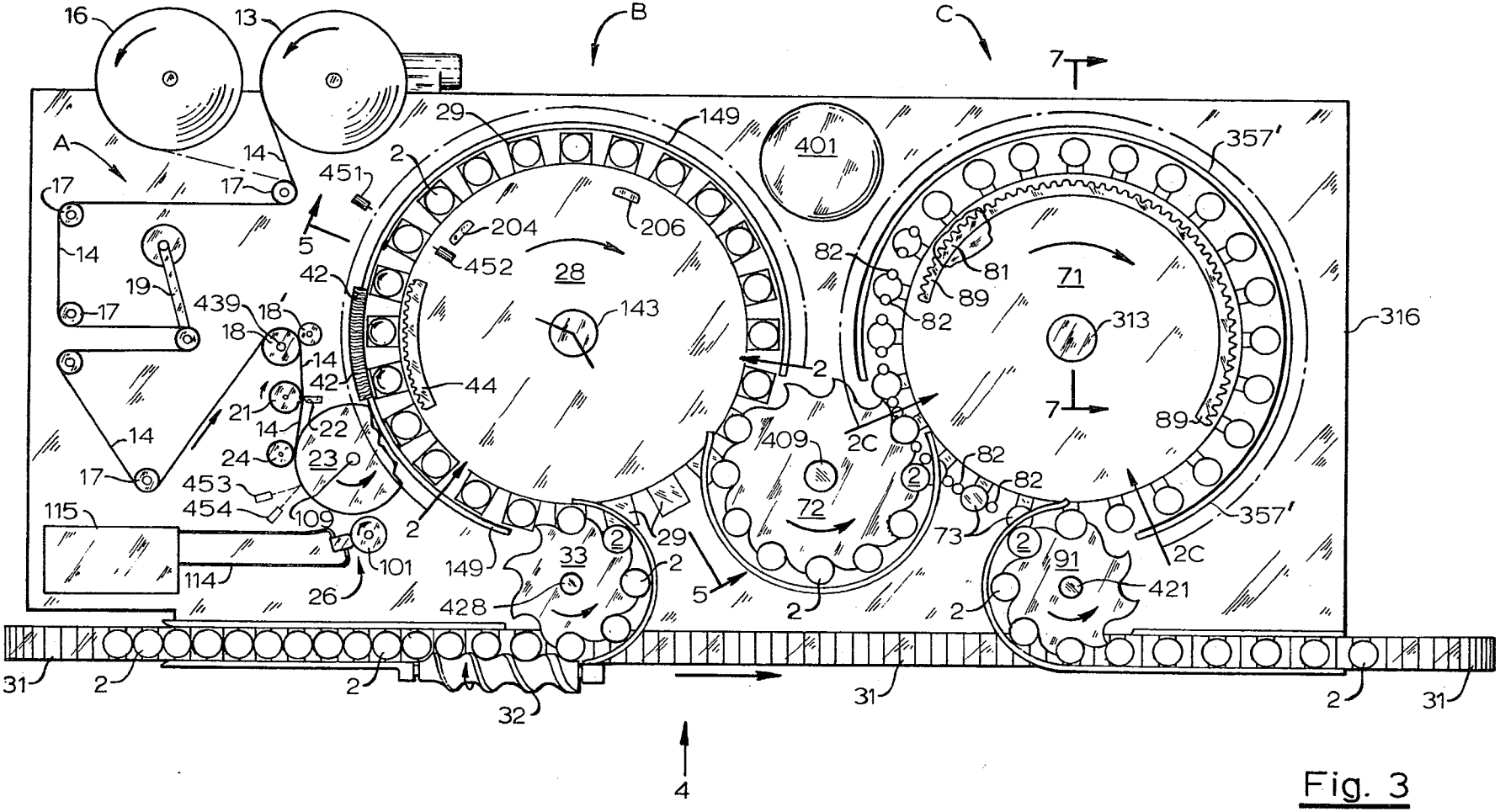
FIG. 3 is a more or less schematic plan view partly in section of the entire apparatus; portions of the structure being broken away to illustrate the construction.
Figure 4:
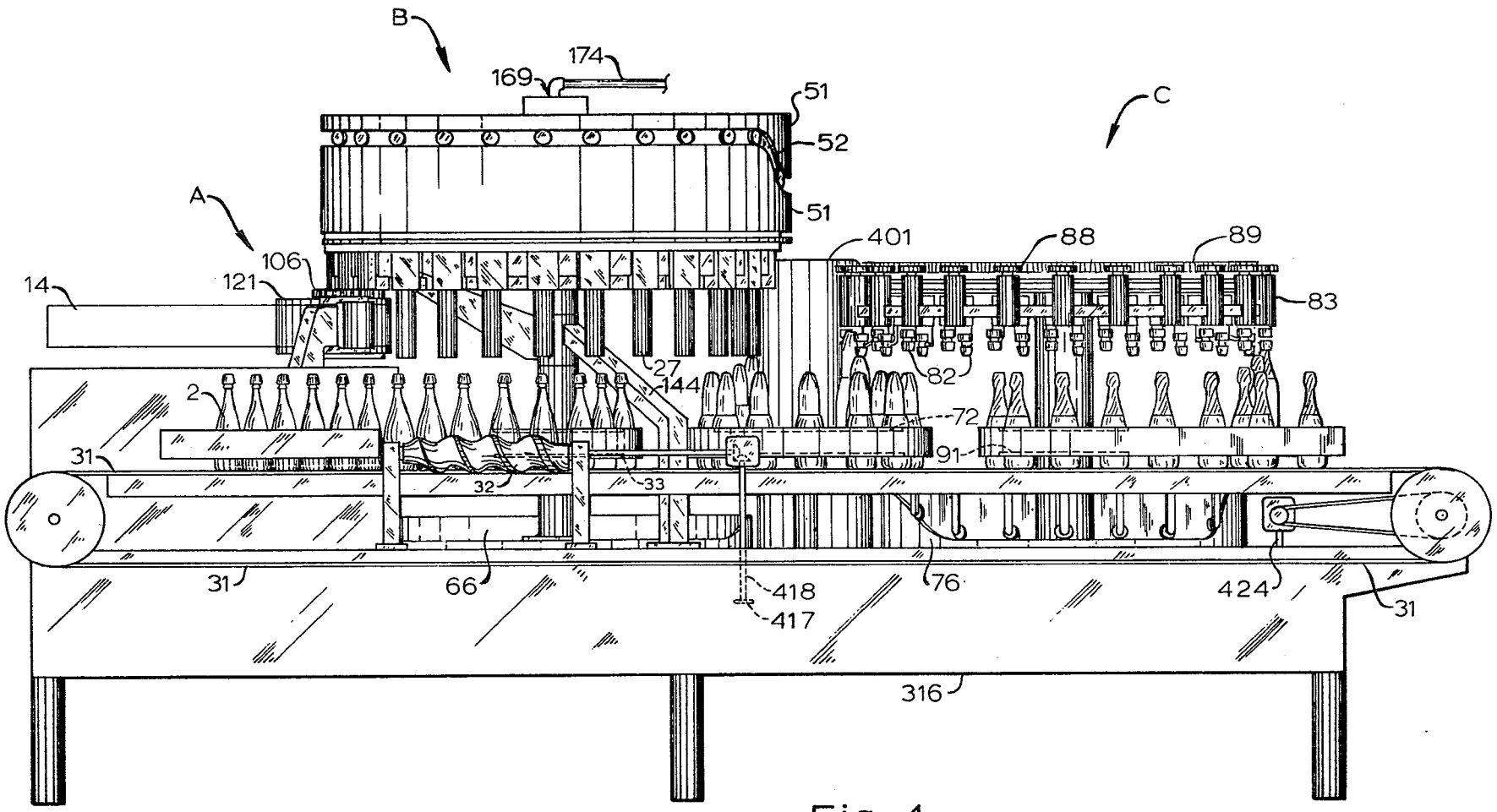
FIG. 4 is a schematic side elevational view of the entire apparatus, looking in the direction of arrow 4 in FIG. 3.
Figures 8, 8A, 8B:
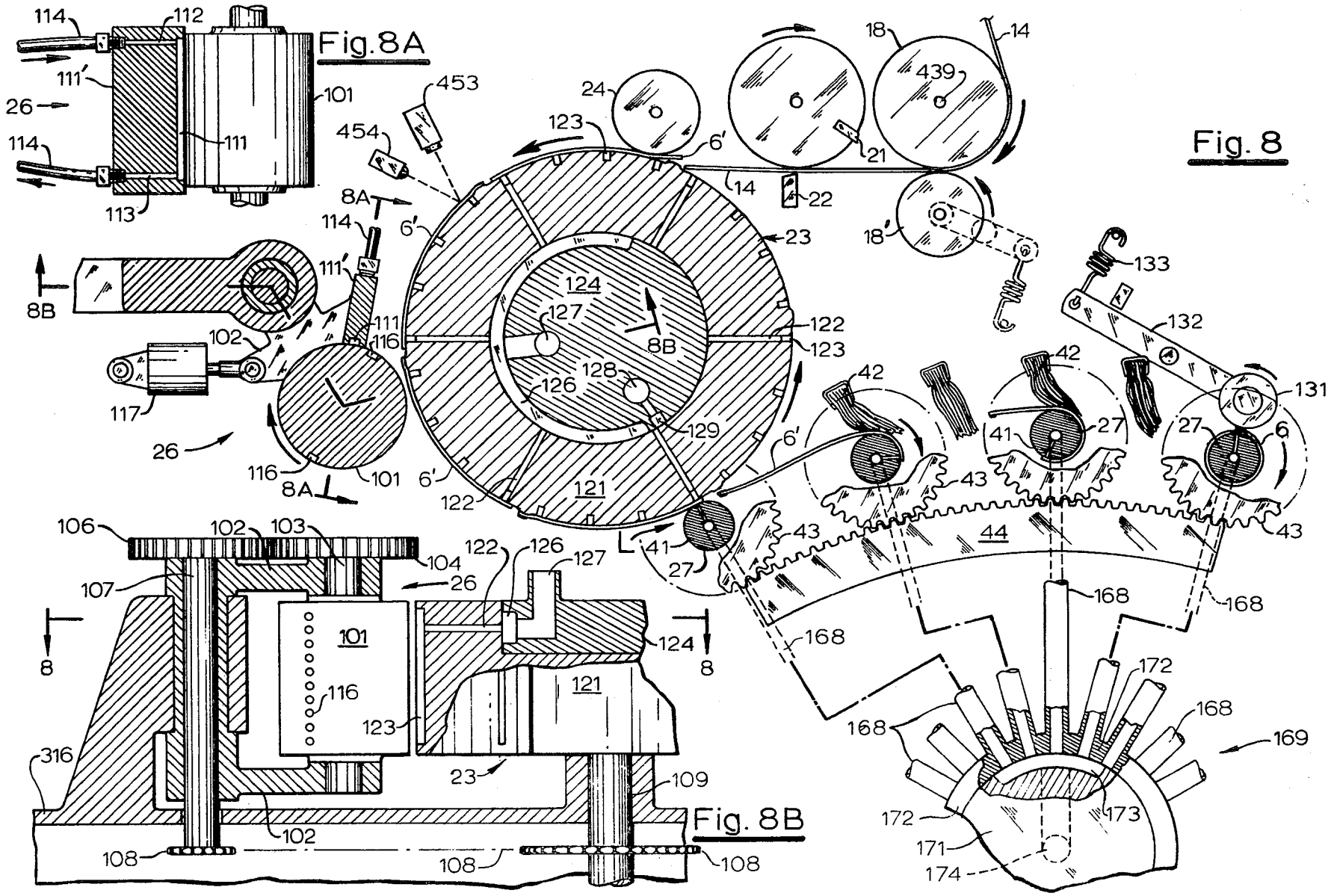
FIG. 8 is a plan view, partly schematic and partly in section, of the capping sheet forming section of the apparatus including the vacuum drum and mandrels for forming capping sleeves, taken in a plane indicated by line 8 — 8 in FIG. 8B.
FIG. 8A is a section of the adhesive applicator taken in a plane indicated by line 8A — 8A in FIG. 8.
FIG. 8B is a vertical section taken in planes indicated by line 8B — 8B in FIG. 8.

In the formation of individual capping sheets from a parent strip of material, reference is made to FIGS. 3, and 8 through 8B. A supply roll 13 is provided for a continuous supply of parent strip material 14, such as the aforementioned lead or metal foil. An auxiliary supply roll 16 is also provided from which a strip material may be withdrawn when supply roll 13 is exhausted. Switching from one supply roll to the other and vice versa is effected by any suitable means commonly employed in the feeding of webs from a parent roll, and forms no part of the instant invention. The strip material, as is conventional, passes over idler rolls 17 and is continously withdrawn from supply roll 13 by suitable constantly driven feed roll 18, cooperating with a spring pressed freely rotatable pressure roll 18'; a conventional form of dancer mechanism 19 being provided to maintain tautness or take up slack in the strip.

As the strip 14 is being constantly and continuously driven it is severed into individual sheets or sections 6' by means of a rotary shear 21 acting against a stationary shear 22 positioned ahead of continuously rotatable suction drum 23. The suction drum grips a leading edge of the strip before it is cut into a sheet by means of cooperating shears 21 and 22; a rubber pressure roll 24 cooperating with vacuum drum 23. The severing and vacuum drum arrangement is described in greater detail in applicant's co-pending application, Ser. No. 226,064, filed Feb. 14, 1972, entitled "METHOD AND APPA-

RATUS FOR APPLYING LABELS TO CONTAINERS".

As previously noted, the severed sheets for making caps are formed into tubular cylindrical form wherein opposite edges of each sheet are secured together in a manner which will be explained later in detail. Adhesive is applied to the outer face of the trailing edge of each successive capping sheet 6' while on vacuum drum 23, by adhesive applicator means indicated generally by reference numeral 26. The vacuum drum operates to grip successive capping sheets 6' and to release them, respectively, to a succession of cylindrical mandrels 27 which are rotatable about their axes by mechanism to be described so that as the respective mandrels are rotated sheets 6' become wrapped around them to form the cylindrical sleeve 6; the mandrels each having suction means to grip the leading edge of successive strips and release the sheets from the vacuum drum, suction on the mandrels being relieved when the sleeves have been formed.

Figures 2, 2A, 2B:
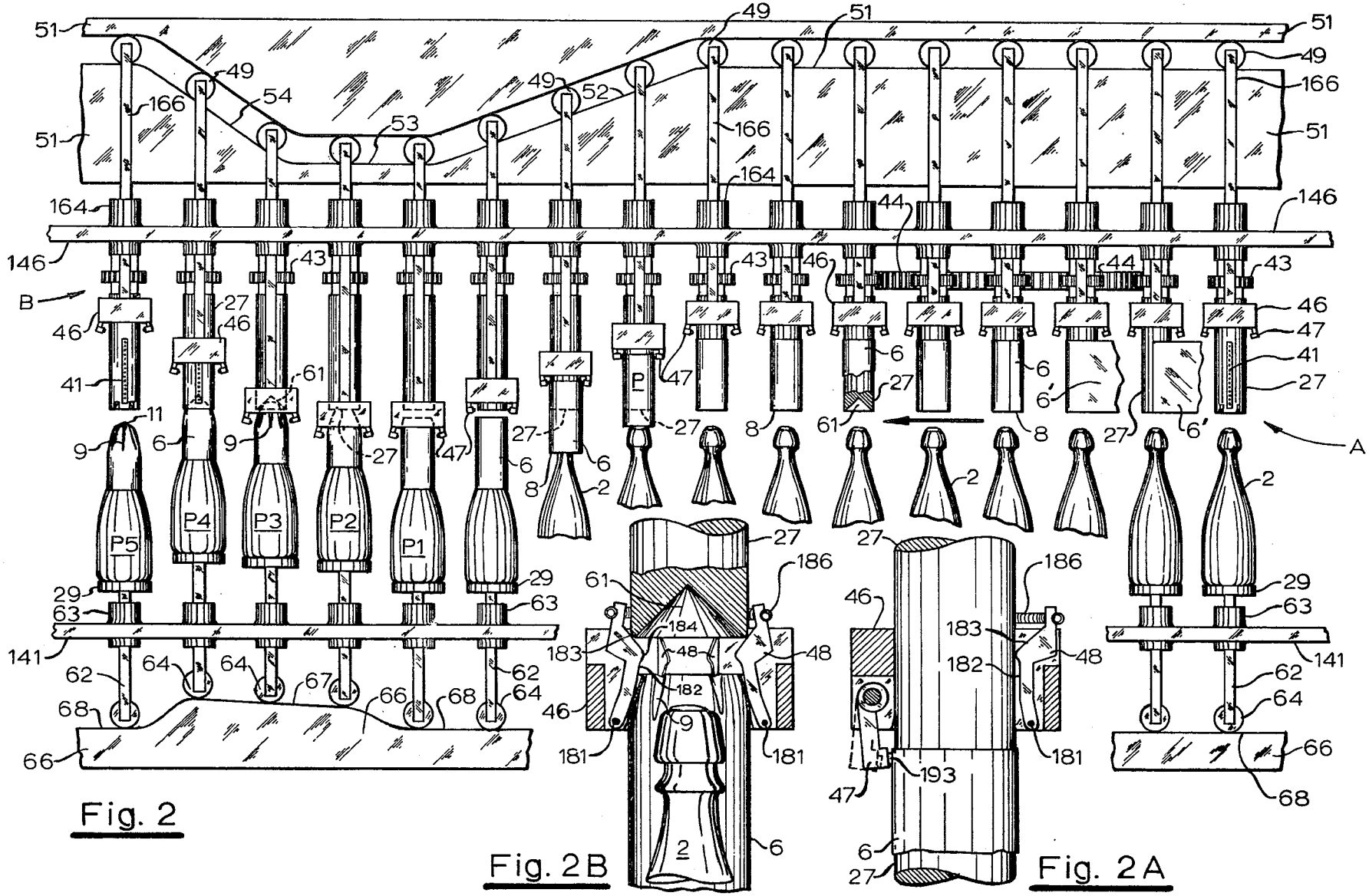
FIG. 2 is a schematic side elevational stretched out view illustrating phases of the sleeve preforming section of the machine, the view being taken in an arcuate plane along section line 2 — 2 in FIG. 3 looking inwardly from the outside.
FIG. 2A is a side elevational view, partly in section, illustrating the ring mounted for up and down movement axially of a mandrel upon which a cylindrically capping sleeve is formed, and which carries creasing blades, and also movably mounted stripping fingers for slipping a sleeve off of the mandrel and over a bottle neck; the dotted line position of a finger illustrating its disengaged position with respect to the top end of the sleeve, the position of the ring and engaged finger being that indicated by letter P in FIG. 2.
FIG. 2B is a similar view illustrating the position of the creasing blades when the ring is moved downwardly sufficiently to cause the blades to engage the top end of the sleeve; the position being that at P1 in FIG. 2.

Reference is made to schematic FIGS. 2 and 3, and to FIGS. 2A and 2B for an explanation of the sleeve formation and preformation of the caps. Mandrels 27 are all of the same length and are carried at the same elevation for orbitol movement by a rotary turret 28 that also carries platforms 29 mounted for up and down movement or elevation. A continuous succession of bottles 2 is conveyed by conveyor 31, and are equally spaced apart in a conventional manner by a rotary screw 32. They are transferred onto platforms 29 by means of a star wheel 33.

As can be seen from FIG. 3, turret 28, and consequently mandrels 27 and the platforms 29 which are alined with the respective mandrels, are orbitally rotated in a clockwise direction. But in FIG. 2, because it is a stretched out view looking from the outside in, mandrels 27 and platforms 29 are shown moving from right to left. The right-hand mandrel 27 in FIG. 2 depicts the situation wherein an edge of capping sheet 6' has not yet been gripped by a longitudinally extending apertured portion 41 which comprises a perforated insert of suitable material, such as rubber, while the mandrel adjacent thereto illustrates an edge of a capping sheet 6' gripped by the mandrel. As the mandrel is rotated about its axis, the sheet becomes wrapped around it as can be seen from FIG. 8; yieldable pressure is applied to capping sheets 6' by brush structure comprising brushes 42. The means for rotating the mandrels abour their axes as they are orbitally moved by turrent 28 in axial alinement with the respective bottles, comprises a gear 43 carried by each mandrel engaging a stationary arcuate rack 44; the rack being of a length sufficient to effect complete wrapping of a capping sheet into cylindrical form about the mandrel. After such wrapping and after a gear 43 leaves rack 44, a spring pressed ball 45 (FIG. 6B) engageable in a detent 45' holds the mandrel against axial rotation with apertured portion 41 in proper fixed position for gripping the leading edge of another capping sheet 6' conveyed thereto.

Each mandrel carries a sleeve stripping ring 46 mounted for up and down slidable movement axially of the mandrel; and as can be noted from FIGS. 2A and 2B the ring carries pivotally mounted sleeve stripping fingers 47, and also a series of spaced apart creasing blades 48. When the sleeve has been completely cylindrically formed, stripping fingers 47 are automatically actuated in a downward position of stripping ring 46, indicated at position F in FIG. 2, to slip sleeve 6 off of the mandrel and over the neck of a bottle 2. Although the mandrels are continuously moved at a constant or fixed elevation, stripping rings 46 are moved downwardly and then upwardly by means of cam follower rollers 49 engaging a cam trackway 51. The cam has a downwardly sloping portion 52 during which the ring 46 moves downwardly, which leads to a short horizontal portion 53 whereat the ring remains at the lower end of the mandrel for a distance. Portion 53 leads to an upwardly sloping portion 54 by which ring 47 is moved upwardly, and remains in the upper position for the rest of the travel of the mandrel until it arrives again at downwardly sloping portion 52.

At position P1, the sleeve has been slipped completely off the mandrel with the stripping fingers 47 completely disengaged therefrom. As can be seen best from FIG. 2B, creasing fingers 48 effect the aforementioned inward creasing 9 at position P1 about peripherally spaced apart locations along the upper edge of the sleeve so that such upper edge portion becomes turned or bent inwardly over the top stoppered end of the bottle. This commences the preforming operation of the sleeve over the neck and top end of the bottle. The successive bottles are carried by the aforementioned platforms 29 in alinement with the respective mandrels at the same elevation up through position P1.

The lower end of each mandrel 27 is formed with a pyramidal or conically shaped mold cavity 61 (FIG. 2B) by which the upper end of the sleeve over the bottle neck is completely bent inwardly into pyramidal shape over the stoppered end of the bottle, after the initial inward bending by the creasing fingers. This preformation simultaneously with further creasing preformation of the sleeve over the neck of the bottle is effected in the following manner.

Platforms 29 are rigidly mounted on rods 62 slidably mounted in sleeves 63; the rods carrying at their lower ends cam follower rollers 64 which ride over a cam 66 fixed to the frame of the apparatus. Cam 66 has a slightly upwardly inclined rise portion 67 and a horizontal portion 68. The respective bottles as they are orbitally moved, are thus elevated gradually as cam follower rollers 64 ride over elevated portion 67 of the cam. Such gradual elevation commences at position P2 next to position P1; and at position P2 the partially tapered end of the sleeve 6 is inserted into mold cavity 61. It is raised further and is further creased along its length as it is raised, as is illustrated in position P3.

At the next position P4 ring 46 is elevated by the cam means 49, 54 but since the upper end portion of sleeve 6 has been pressed into engagement in mold cavity 61 it is completely formed into the conical shape, shown in FIG. 1B and which is illustrated at position P5 in FIG. 2. Thus, preformation of sleeve 6 to conform partially to the shape of the bottle neck and bottle stopper has been completed.

With particular reference to FIG. 2B, it will be noted from the above that inward creasing of sleeve 6 commences before the sleeve is pressed into mold cavity 61. This initial creasing decreases the sleeve diameter at is top end. Hence, the sleeve can be inserted into mold cavity 61 even though the inside diameter of the sleeve before the creasing is effected, is substantially equal to the outside diameter of mandrel 27.

All the foregoing performations of the respective sleeves 6 to conform partially to the shape of the bottle neck and the stopper end of the bottle, is accomplished in rotary turret 28 which forms the second section of the machine. The final molding of the partially preformed sleeve to the shape of the bottle neck and its stopper end is effected in a second turret 71 to which the bottles having the preshaped caps thereon are transferred from turret 28 to turret 71 by means of another conventional star wheel 72.

Figure 2C:
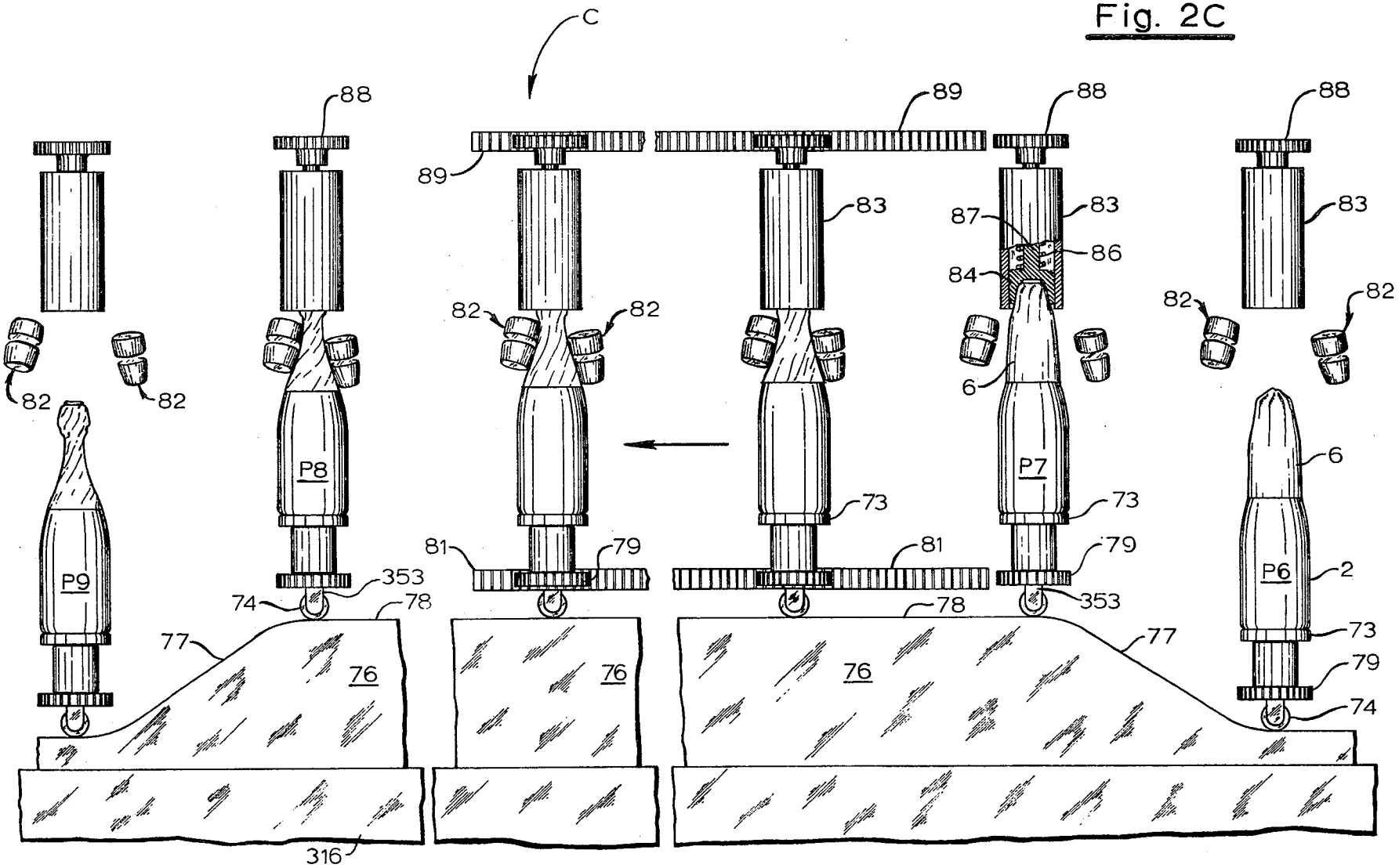
FIG. 2C is a developed stretched out schematic view, similar to FIG. 2, illustrating various stages of the molding steps on the preformed sleeve, taken in an arcuate plane indicated by the section line 2C — 2C in FIG. 3, also looking inwardly from the outside.

The molding of the caps is schematically illustrated in FIGS. 2C and 3. As with respect to FIG. 2, FIG. 2C reads from right to left because the section line 2C — 2C in FIG. 3 is looking from the outside in. Fixed for rotation with turret 71 are a plurality of platforms 73 mounted for up and down movement by means of cam follower rollers 74 riding on a cam 76. Cm 76 has two rise portions 77 and an elevated horizontal portion 78. Platforms 73 are mounted for rotation about their respective axes, and rotatable with the platforms are gears 79. Right after cam follower rollers 74 engage elevated horizontal portion 78 of cam 76, gears 79 engage a stationary arcuate rack 81 which as the bottles are continuously moved effects rotation thereof about their axes on elevated portion 78. Turet 71 also carries for rotation therewith molding roller structure comprising spaced apart sets of molding rollers 82, one set opposite each bottle which is transferred onto turrent 71.

Also, turret 71 carries housings 83 in alinement with the top ends of the respective bottles having the preformed caps; and a mold cavity 84 is slidably and rotatably mounted in the housing, being spring pressed downwardly by means of a spring 86. Mold cavity 84 is rigid with a shaft 87 extending through the top wall of housing 83 which forms an abutment for the spring 86; and shaft 87 carries a gear 88 engageable with an arcuate rack 89 fixed to the frame of the turret.

From the preceding it is seen that the molding rollers 82 are initially spaced apart sufficiently so that a bottle neck may enter therebetween; and in the position P6 shown in FIG. 2C, a bottle 2 is below the housing 83 and below the set of molding rollers 82. From this position, the bottle is raised as platform 73 is elevated along cam rise 77, which results in the upper or stopper end of the preformed caps to be pressed into engagement in mold cavity 84 as is illustrated at position P7.

Upon further travel of the bottle along elevated horizontal portion 78 of the came and while the bottle is resiliently clamped between platform 73 and mold cavity 84, gear 79 in engagement with rack 81 and gear 88 in engagement with rack 89 cause the bottle to be rotated about its axis in unison with mold cavity 84 which rotates within housing 83. As the bottle is continuously moved further along cam 76, the freely journalled rollers 82 are moved inwardly by yieldable pressure means to be described later, and clamped against the neck of the bottle.

Thus it is seen that rollers 82 are not rotated by positive drive means but being freely journalled, they may assume a neutral position; and at the same time the end of the sleeve bent inwardly over the bottle stopper is flattened at 12 to conform to the shape of the stoppered bottle end as is shown in FIG. 1C. At the time platform 73 arrives at the end of elevated portion 78 of the cam, at position P8, rollers 82 of the respective sets are moved out of engagement with the bottle neck to their initial position for receiving another bottle therebetween, upon further orbital rotation of turret 71, as is shown at position P9. The completely capped bottle having the cap molded over the bottle neck and stopper end is moved by turret 71 to another star wheel 91, (FIG. 3) which transfers the capped bottle to conveyor 31.

The molding roller arrangement is an important aspect of the invention, and will be described in greater detail later together with other features of the apparatus which have been described generally.

ADHESIVE APPLICATION AND VACUUM DRUM

Referring again to FIG. 8, 8A and 8b, although any suitable means by be employed for applying adhesive to the outer face of a capping sheet 6', a preferred form comprises adhesive applicator roller 101 rotatably mounted on a bracket 102 by means of journalled shaft 103 carrying a gear 104 meshing with drive gear 106 carried by drive shaft 107 about which bracket 102 can pivot; drive shaft 107 being driven by sprocket and chain connection 108 from shaft 109 which drives suction drum 23. Hot melt adhesive is continuously circulated through a passageway 111 in a block 111' fixed to pivoted bracket 102. Passageway 111 communicates with an inlet passage 112 and with an outlet passage 113 connected to conduits 114 in turn connected to a hot melt reservoir 115 (FIG. 3) containing suitable pumping means for circulating the hot melt.

Adhesive applicator roll 101 is provided with a series of transversely exteding diametrically opposite perforations 116 which, as the roll is rotated, wipe past passage 111. Consequently adhesive is thus transferred to roll 101, which applies it to the outer face of the trailing edge portion of each successive capping sheet 6' while on the suction drum. The adhesve application which, as previously indicated, is mounted for pivotal movement is brought into and out of engagement with the successive capping sheets at the proper time by means of an actuator 117 which may be of any suitable electro-magnet construction operated at properly timed intervals. In this connection, it will be noted that since passage 111 is in block 111' secured to the same bracket 102 as applicator roll 101 is mounted, the roll continuously engages over passage 111 so that adhesive is only transferred to perforations 116' when they pass by passage 111.

The above described adhesive applicator is preferred for hot melt adhesive application but any other type of applicator, such as disclosed in applicant's aforementioned application may be employed.

VACUUM DRUM

After adhesive is applied to the outer face of the trailing edge of the respective capping sheets 6', transferred to vacuum drum 23, the sheets are continuously conveyed by the drum to the successive mandrels 27. Vacuum drum 23, as can be seen best from FIGS. 8 and 8B, is of more or less conventional structure common to labeling apparatus. Generally, it comprises a cylindrical rotor 121 having radial passages 122 communicating with transversely extending passages 123 in the periphery of the rotor. Rotor 121 is journalled for rotation about a stator plate 124 which has an arcuate pasage 126 to which suction is applied from a suitable source through a conduit 127.

Thus, the gripped capping sheets are held to the periphery of the drum by application of suction as they pass by passage 126. Passage 126 terminates (the right-hand portion appearing in FIG. 8) adjacent successive mandrels 27 as they are continuously moved so that at such location indicated by reference letter L in FIG. 8, the leading edge portion of each successive capping sheet 6' can be transferred to the mandrel by axially extending aperture portion 41 of the mandrel to which suction is applied. To facilitate such transfer, plate 124 has an aperture 128 open to the atmosphere and communicating with a transversely extending slot 129 in the periphery of plate 124. When a radial passage 122 passes by slot 129, the vacuum thus becomes ineffective so that the leading edge of a capping sheet 6' may be picked up quickly by suction applied to the mandrel 27 and transferred thereto. If desired, passage 128 may be connected to a continuous source of pressure to further enhance the transfer.

After such transfer to a mandrel has been effected and the mandrel continuously conveyed while it is rotated about its axis, the capping sheet is formed into a cylindrical sleeve about the mandrel, as previously pointed out, and such formation is facilitated by the yieldable brush structure 42 comprising a plurality of spaced apart brushes. After a sleeve 6 has been completely formed on the right-hand mandrel 27 appearing in FIG. 8, a spring pressed pressure roll 131 journalled on a pivotally mounted lever 132 anchored to coil spring 133, applies pressure to the bonded edges of sleeve 6 to insure complete bonding by the adhesive.

MANDREL STRUCTURE

Figure 5:
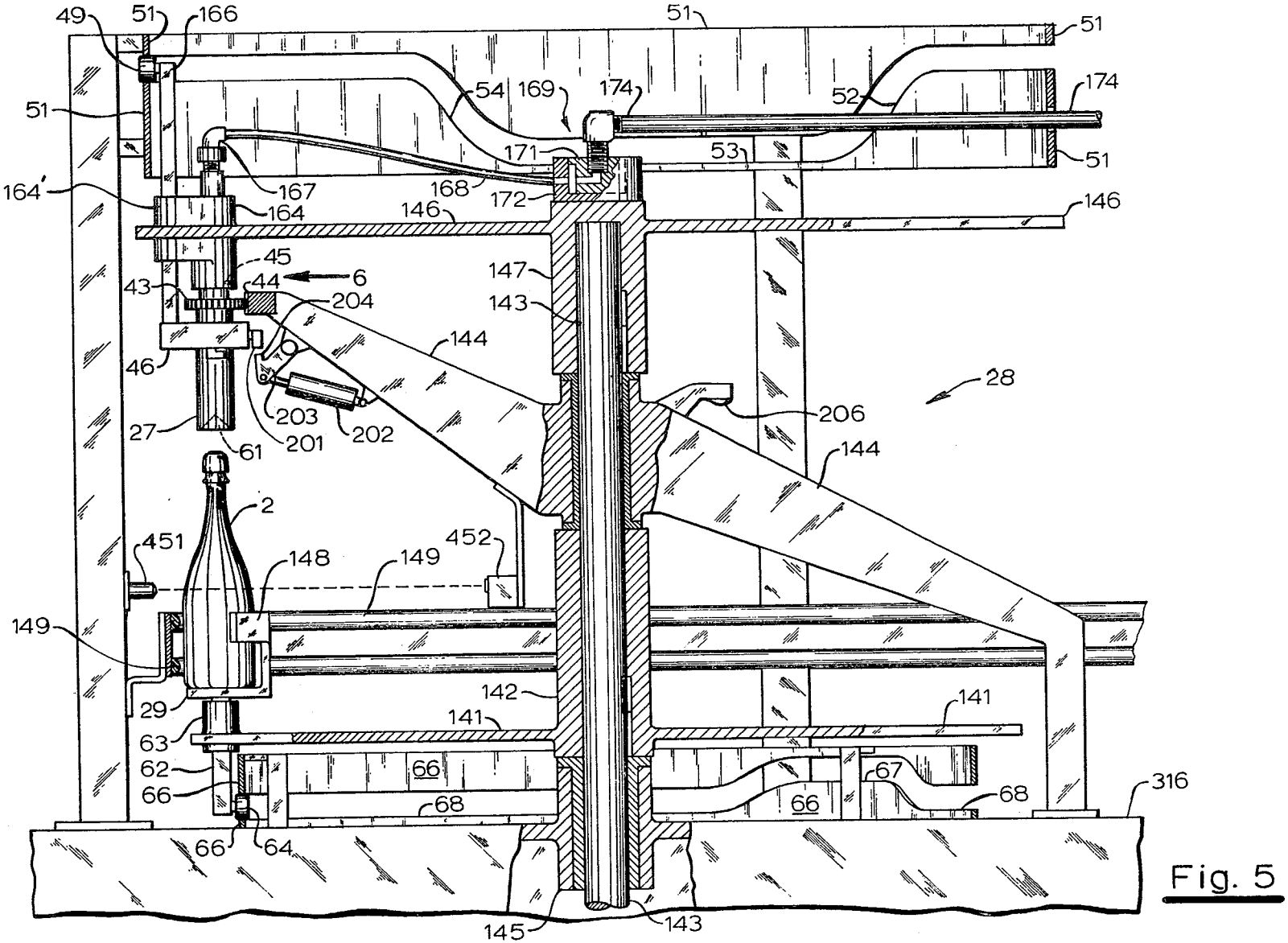
FIG. 5 is a fragmentary vertical sectional view, partly in elevation, taken in planes indicated by line 5 — 5 in FIG. 3, at a position wherein a sleeve formed on a mandrel is about to be stripped or slipped off therefrom onto a capped bottle illustrated in the Figure.

As was previously discussed, the successive bottles are conveyed in axial alinement with the respective mandrels 27, and sleeves formed on the mandrels are preformed on the necks of the bottles. Further details are best shown in FIGS. 5, and 6 through 6B. Rotary turret 28 which conveys the successive bottles and mandrels comprises a bottom plate 141 fixed to a hub 142 keyed to drive shaft 143 which is journalled in a stationary spider 144, and also in a hub 145 fixed to the base of the turret. It also comprises an upper plate 146 fixed to hub 147 also keyed to the drive shaft 143 so that both plates 141 and 146 rotate in unison. Upper plate 146 carries the mandrels 27 while lower plate 141 carries the bottle supporting platforms 29. As can be seen best from FIG. 5 each platform 29 has an arcuate bottle retaining arm 148 which cooperates with stationary arcuate guide rings 149 to retain the bottles in relatively fixed position on the platforms as they are conveyed.

Referring to FIGS. 5, and 6 through 6B, it will be noted that each mandrel 27 is a cylindrical shaft which has an axially extending passage 161 extending therethrough communicating with a laterally extending passage 162 near the bottom which in turn communicates with the apertured portion 41 which grips the leading edge of each cap forming sheet. The upper end of each mandrel shaft 27 has a reduced spindle portion 163 journalled in a bearing block 164 integrally fixed with upper plate 146 of turret 28; and the aforementioned gear 43 is fixed to mandrel shaft 27. Block 164 has a lateral extension 164' in which is slidably mounted a rod 166 which carries at its lower end the aforementioned stripping ring 46, and at its upper end the aforementioned cam follower roller 49. Thus the stripping ring 46 is slidably mounted for up and down movement as cam follower roller 49 travels over cam trackway 51.

Suction is applied through passage 161 in the following manner. Each spindle 163 of mandrel 27 carries at its upper end a rotary union seal 167 of conventional construction, which when moved orbitally together with the mandrel permits axial rotation of the mandrel during the portion of its orbital movement in turret 28 wherein gear 43 engages stationary rack 44. Union 167 is connected by a conduit 168 to a rotary valve 169 which has a stator 171 and a rotor 172, as is illustrated in FIG. 8. The respective conduits 168 connected to the respective mandrels 27 are also connected to rotor 172 so that they rotate in unison with the mandrels.

Stator 171 has an arcuate peripheral passage 173 which is connected by a conduit 174 to a constant vacuum source (not shown). Thus as rotor 172 passes over stator passage 173 suction is applied to the respective mandrels 27 only as long as the conduits 168 connected thereto communicate with passage 173 but when the conduits are in sealing relationship with stator 171, the suction is not applied or in other words relieved, so that a sleeve formed on the mandrel can be slipped off the mandrel and transferred to a bottle. The passage 173 is of such length that suction is applied during the period that the respective mandrels are axially rotated as they engage stationary rack 44 to cause a capping sheet to be wound about the mandrel to form a sleeve.

CREASING BLADES AND STRIPPING FINGERS

With particular reference to FIGS. 2A, 2B, and 6 through 6B, it will be noted that each of the aforementioned creasing blades 48 which are mounted on a stripping ring 46 for in and out movement, is pivotally mounted at 181 adjacent its lower end in ring 46. Each blade comprises an upwardly extending inner creasing edge 182 and an outwardly and upwardly extending cam edge 183 engageable with the lower edge of the mandrel in the downward position thereof as shown in FIG. 2B. A slide bearing 184 is formed between such edges, which can ride against the outer surface of mandrel 27 as the ring moves up and down along the mandrel. Means is provided for resiliently urging the creasing blades inwardly comprising a garter spring 186 engaging the upper ends of the blades.

From the preceding, it is seen that when ring 46 is moved to downward position whereat slide bearing 184 is below the base of mold cavity 61, creasing edges 182 are thrust inwardly by the spring 186 to commence the formation of the aforementioned creases 9 as is depicted in FIG. 2B which shows the initial formation of such creases. When slide bearings 184 engage the outer surfaces of mandrel 27, creasing edges 182 are maintained out of engagement with the mandrel. In this connection, the aforementioned arrangement of cam surfaces 52, 53 and 54 is such that the respective rings 46 are moved up and down in properly timed relationship with movement of the bottles.

STRIPPING FINGERS

Stripping fingers 47 are each secured to a pivot shaft 191 and comprises a downwardly extending arm 192 carrying buttons 193, desirably of rubber, to engage a sleeve formed on the associated mandrel 27 and remove the same therefrom. Secured to the left-hand pivot shaft 191 appearing in FIG. 6 is an arm 194 engaging in a recess 196 in forked arm 197, which is secured to the right-hand pivot shaft in FIG. 6. By such arrangement, stripping fingers 47 which are opposite each other, can be moved inwardly simultaneously to engage a sleeve 6 on the mandrel and thus effect the stripping, and to be moved outwardly simultaneously so as to be diengaged from the mandrel after the stripping action. A spring pressed ball 198 is adapted to engage either one of a pair of detents 199 in arm 197 to hold the stripping fingers 47 in either engaged or disengaged relationship with respect to the associated mandrel 27.

Means is provided for effecting such engaged or disengaged relationship in properly timed relationship with movement of the sleeved bottles. Such means comprises a cam button 201 on each of the upper and lower faces of the forked arm 197 appearing in FIG. 6. Normally stripping fingers 47 are in disengaged relationship when the bottles are conveyed at their normal elevation. However, at the proper time, when a ring 46 on an associated mandrel 47 is initially lowered by cam surface 52 (position P in FIG. 2) an air cylinder 202 (FIG. 5) which is at a fixed location and is connected to a lever 203 carrying a cam 204, is actuated to engage lower cam button 201 and thus effect engagement of stripping finger buttons 193 with the top end of the sleeve on the mandrel; the detent holding the stripping fingers in engaged position. As the ring 46 is further lowered, sleeve 6 is thus slipped off of the mandrel over the bottle neck. When the sleeve has been completely stripped from a mandrel, and the bottle has been moved orbitally away from cam 204, stripping fingers 47 are actuated to disengaged position by means of the upper cam button 201 (FIG. 6) engaging the underside of a stationary cam 206 shown in FIGS. 3 and 5; stationary cam being fixed to stationary spider 144.

In this connection, it will be recalled that after the inward creasing of the end portions of the sleeves and stripping of the sleeves from the mandrels previously explained, and after pressing of the top ends of the sleeves into mold cavities 61 at the lower ends of the mandrels, the thus preformed sleeves on the bottle are continuously conveyed by means of star wheel 72 into the molding section C of the apparatus.

MOLDING SECTION

With particular reference to FIGS. 2C, 3, 4, and 7 through 7G, the molding section C comprises an upper turret plate 311 and a lower turret plate 312 both of which are keyed to a drive shaft 313 so as to be rotatable therewith. Such shaft is journalled for rotation in a fixed lower hub 314 formed on the base 316 of the apparatus. Also, it is journalled in its upper end in a non-rotatable hub 317 anchored to the frame of the machine and connected to spaced apart cam plates comprising lower plate 318 and upper plate 319 between which is a brace plate 321 to provide rigidity. Such cam plates form part of the actuating means for the aforementioned molding rollers 82 and will be described in further detail later. As can be seen from FIG. 7E, the cam plate structure 318, 319 is anchored against rotation by torque link 320 connected to a frame portion 320' of the apparatus.

Rigidly secured to the described cam plate structure 318, 319 is a bracket 322 which carries the aforementioned arcuate fixed track 89 meshing with gear 88 which in conjunction with gear 79 and arcuate rack 79 (FIG. 7) effect rotation of bottle 2 about its axis during a portion of its orbital travel, as was previously explained.

Upper turret plate 311 carries a pair of pivot shafts 323 and 323' displaced arcuately, each of which is journalled in a hub 342 integral with turret plate 311. Secured to the front pivot shaft 323 as they appear in FIGS. 7A and 7D is a sleeve 326 which extends above a similar sleeve 327 secured to the rear pivot shaft 323'. Rear sleeve 327 carries an arm 328 on which is journalled a cam follower roller 329 which rides over fixed lower cam plate 318. Similarly front sleeve 326 carries an arm 331 on which is journalled a second cam follower roller 332 which rides over the cam surface of upper cam plate 319. These cam rollers 329 and 332 are urged into engagement with the cam surfaces of plates 318 and 319, respectively, by springs 333 connected at their rear ends, respectively, to the arm 328 which is secured to rear sleeve 327 and to an arm 328' fixed to the front sleeve 326; the opposite ends of such springs being anchored by pins 334 fixed to upper turret plate 311.

Extending outwardly from the lower end of pivot shaft 323 and connected thereto by means of hub 336 is an arm 337 which carries a molding roller structure 82. Similarly, fixed for pivotal movement with the other pivot shaft 323' is an arm 338 which carries a second molding roller structure 82 cooperable with the other previously mentioned roller 82 in a manner to be described later.

From the preceding, it is seen that the molding roller mounting structure provides a pair of pivoted bell crank structures which by means of springs 333 continually urge the opposite rollers of each set of molding rollers 82 toward a position for engaging the bottle as can be seen from FIG. 7D. The cam plate structure 318, 319 provides means for allowing the molding rollers 82 to be spaced apart to receive a bottle therebetween; and in timed relationship with movement of the turret they bring the rollers into molding engagement with the preformed cap on the container.

Figures 7, 7B, 7C, 7F, 7G:
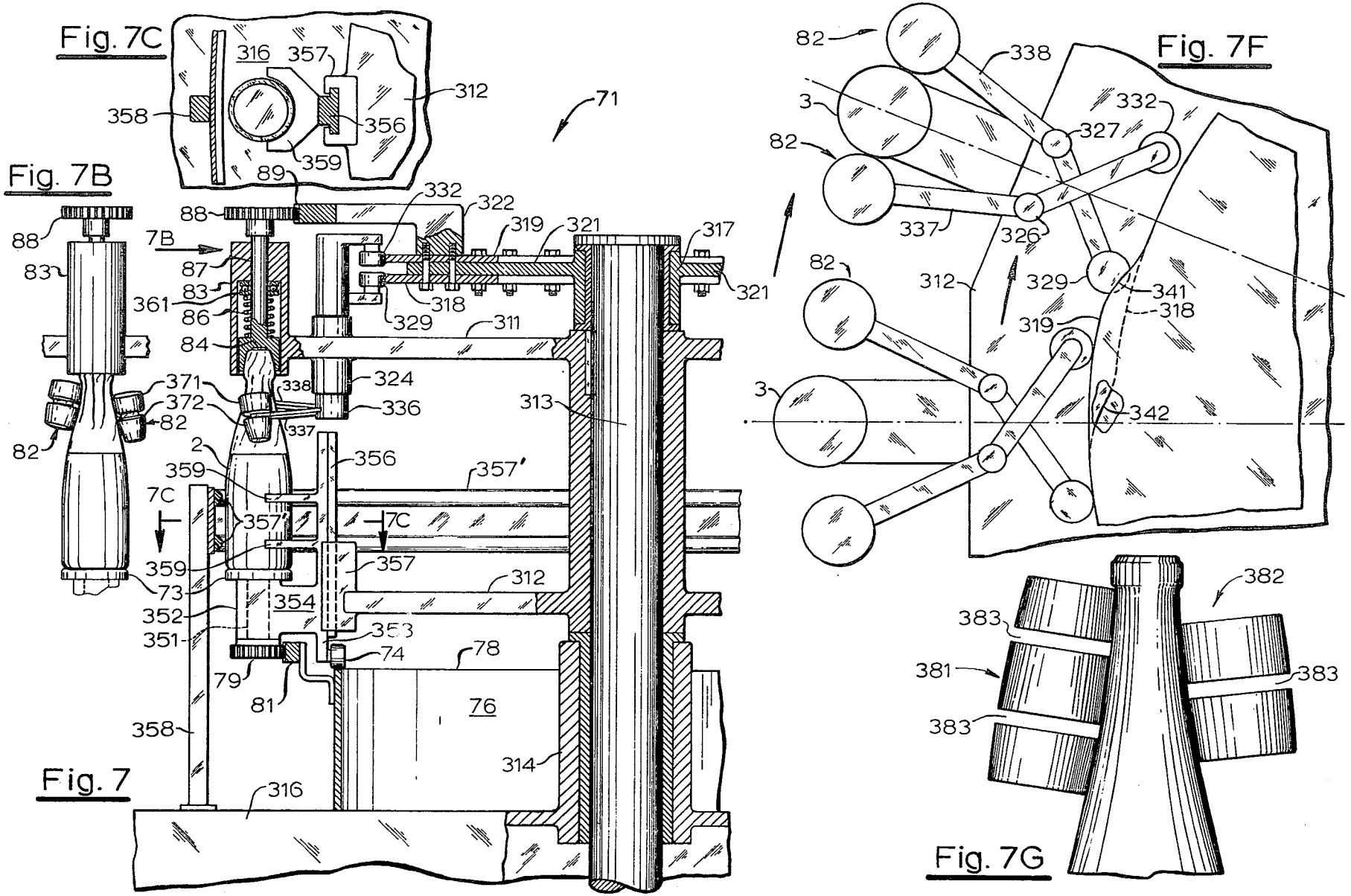
FIG. 7 is a vertical transverse sectional elevation of the molding portion of the apparatus, taken in a plane indicated by line 7 — 7 in FIG. 3.
FIG. 7B is a fragmentary elevational view looking in the direction of arrow 7B in FIG. 7.
FIG. 7C is a fragmentary horizontal section taken in a plane indicated by line 7C — 7C in FIG. 7.
FIG. 7F is an enlarged schematic fragmentary plan view of the cam arrangement shown in FIG. 7E, illustrating different positions of the sets of molding rollers.
FIG. 7G is a schematic elevational view illustrating a modified arrangement of molding rollers.

As can be seen best from FIGS. 7E and 7F, the cam plates 318 and 319 have a profile in the form of arcs of a circle so that the cam follower rollers 329 and 332 can, respectively, ride thereover to maintain the respective sets of rollers 82 spaced apart to receive a bottle therebetween. However at the locations where a bottle 2 is to be received between molding rollers 82, cam edge 319 has an inwardly sloping portion 341 and cam edge 318 has a similar inwardly sloping portion 342.

Sloping portions 341 and 342 are angularly displaced to the extent that as cam follower rollers 329 and 332, respectively, are moved orbitally they engage these portions simultaneously to effect simultaneous inward movement of the molding rollers 82 under the action of springs 333 to thus clamp against the container neck as is seen from FIG. 7F. In this clamping position, it will be noted that the cam arrangement is such that after the clamping rollers are brought into engagement with the container neck they do not engage against the cam surfaces of plates 318 and 319 so that during the clamping they have unrestrained clamping pressure against the container neck. This can be readily effected by predetermining the diameter of the circular portions of the cam surfaces of plates 318 and 319. At a position approximately 180° opposite the sloping edges 341 and 342, as can be seen from FIG. 7E, rise portions 343 are provided to move the molding rollers apart after the molding operation has been completed.

As previously related, when the bottles with the preformed caps thereon are introduced or conveyed into the molding section C, they are received on platforms 73 which are then elevated as the turret rotates, into clamping engagement with the respective mold cavities 84 which shape the sleeve to the stoppered end of the bottle. For this purpose, each aforementioned platform 73 is supported on the upper end of a shaft 351 (FIG. 7) journalled for rotation in a hub 352 and which carries at its lower end gear 79 engageable with the aforementioned arcuate rack 81 which is fixed to the support for the aforementioned cam 76 over which cam roller 74 travels. Roller 74 is journalled on a bracket 353 rigid with an extension 354 of hub 352.

Hub 352 and extension 352 are rigid with a slide bar 356 slidable up and down in a trackway 357 which is fixed to the periphery of rotatable turret plate 312.

By this arrangement, each bottle 2 when received from rotary turret 28 onto a platform 73 can be elevated from a lower position to an upper position (shown in FIG. 7) wherein it becomes clamped between platform 73 and mold cavity 84, and then can be lowered after the cap has been molded to conform to the shape of the bottle neck. In this connection, it will be noted that each bottle 2 is completely elevated by cam roller 74 riding over the right-hand rise portion 77 of cam 76 (appearing in FIG. 2C) before gear 79 is raised to the same elevation as rack 81, to thus enable ready meshing of the gear with the rack.

For retaining each bottle 2 in relatively fixed position on the associated platform 73, outer guide rails 357' are provided which are supported on uprights 358 fixed to base 316 of the apparatus. Also, for the same purpose, inner cradles 359 are provided which are rigidly secured to the aforementioned slide bar 356.

Referring back to mold cavity 84 and associated elements, it will be noted from FIGS. 7 and 7A that housing 83 in which it is rotatable and slidably mounted, is fixed to the outer end of upper turret plate 311; and spring 86 interposed between the hed of the mold cavity and the top abutment wall of housing 83 bears against rotatable thrust bearing 361. Thus, when the bottle is elevated it is in rigidly clamped position but it can be rotated about its axis to effect the complete molding of the cap so as to conform to the neck of the bottle as was previously explained with reference to FIG. 2C; and it will be noted that after completion of the molding (position P8 in FIG. 2C) the molding rollers 82 are separated as cam follower roller 74 rides down the downwardly sloping portion 77 of cam 76; the operation being effected by the aforementioned cam slopes 343 (FIG. 7E).

MOLDING ROLLER ARRANGEMENT

The molding rollers structure of each set is shaped to conform to the configuration of the tapered neck of the bottle and desirably comprises an upper roller 371 and a lower roller 372 at each side of the bottle. The rollers are fixed to hubs 373 which are journalled for free rotation about mounting spindles 374. It will be noted that each pair of upper and lower rollers 371 and 372 are spaced apart and are mounted for limited universal movement (FIG. 7A) by means of a pin 376 extending from the outer end of each arm 337 and 338 which passes loosely through an aperture 377 in the associated spindle 374. This is for the purpose of providing a floating mount for each pair of rollers 371 and 372 to facilitate conformation to the neck of the bottle. Inasmuch as the neck of the bottle tapers and is consequently of larger diameter at its lower end than at its upper end, enhancement of conformation to the neck of the bottle is effected by varying diameters of the rollers; the lower rollers being of lesser diameter than the upper rollers.

It will also be noted from FIGS. 7 and 7B that arms 337 and 338 are vertically staggered, being inclined from the vertical. This enables the rollers to cover a relatively wide area as the bottles drive the same; and from FIG. 7B it will be observed that by virtue of this vertical staggering, the space between the upper and the lower rollers of each pair is traversed by a roller of the other pair. Also, by having a plurality of rollers which are journalled independently at each side of a bottle, this enables the rollers to be driven by the bottle at different speeds without tearing the cap formed from sleeve 6, which would otherwise occur from the varying diameter of the bottle neck.

Also, because of the roller arrangement, they exert a downward pull on the cap as it is being molded, to further enhance shaping of the cap to conform to the shape of the bottle neck. In this connection, the rollers are of any suitable material which will not tear the capping material, and yet have a limited give under the yielding pressure exerted by the aforementioned resilient means 333. A suitable material is rubber of medium hardness.

Repeating the molding operation, it is again to be noted that the respective rollers are not positively driven. They are freely journalled, and when a bottle is clamped between a mold cavity 84 and a bottle carrying platform 73 in vertical alinement therewith, its axial rotation is effected in the manner described previously to thus drive the rollers by the bottle; and by virtue of the limited universal movement and varying diameter of the rollers, they can adjust themselves to a position for effecting the molding without tearing the cap material.

Although a pair of upper and lower rollers is preferably employed at each side of the bottle, which are clamped against the container neck in the manner described, the rollers may comprise a set of three rollers 381 at one side and a pair or rollers 382 at the opposite side, as is shown in FIG. 7G with the space 383 between the rollers arranged so that each space is transversed by a roller as the rollers are driven by bottle 2.

DRIVE MECHANISM

Figure 9:
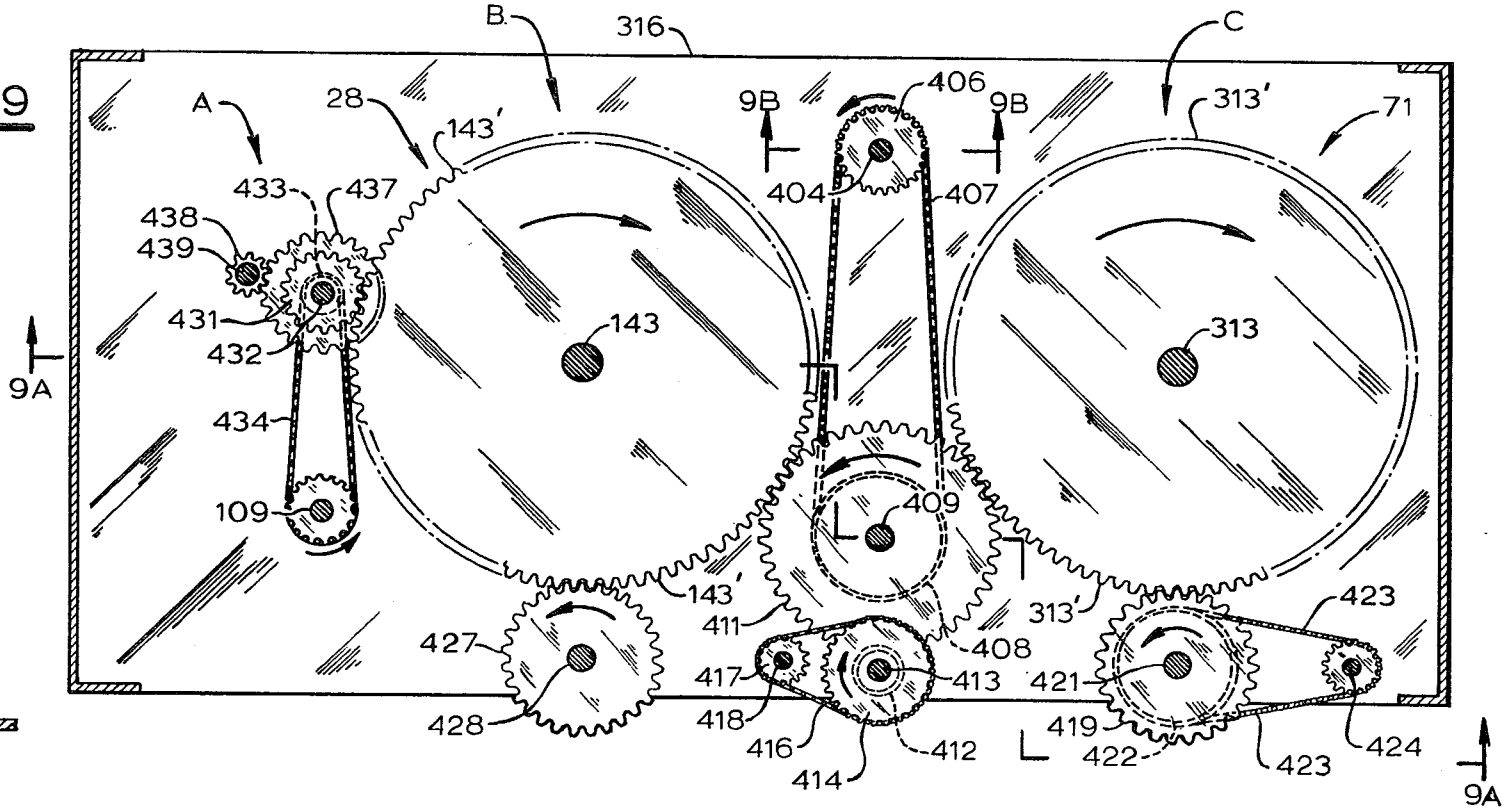
FIG. 9 is a plan view, partly in horizontal section, illustrating drive mechanism for the entire apparatus taken in a plane indicated by line 9 — 9 in FIG. 9A.
Figure 9A:
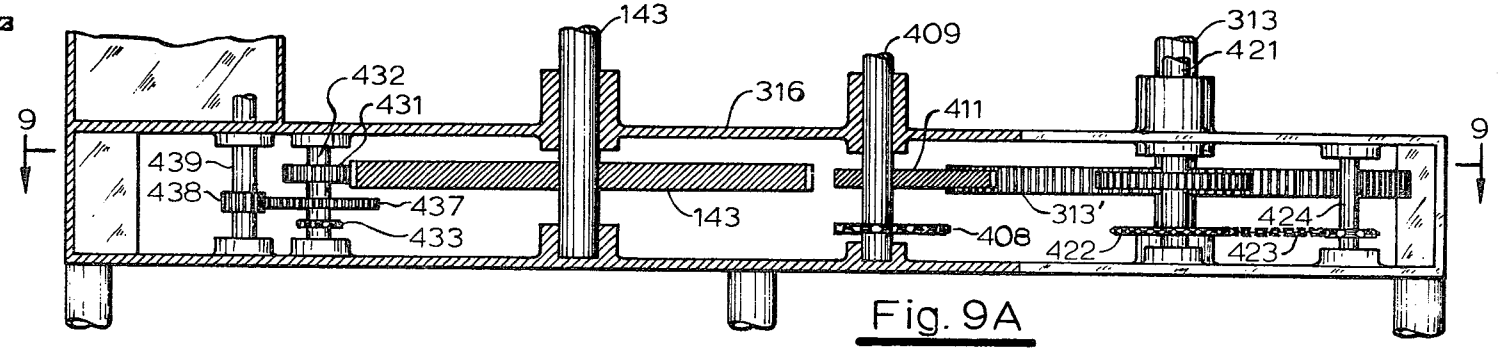
FIG. 9A is a vertical section taken in planes indicated by section lines 9A — 9A in FIG. 9.
Figure 9B:
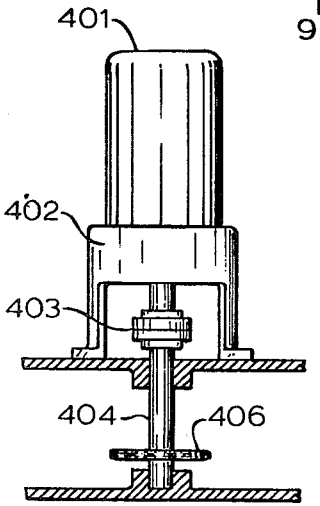
FIG. 9B is a vertical section taken in a plane indicated by line 9B — 9B in FIG. 9.

Any suitable driving arrangement may be employed for operating the various driven components of the apparatus in properly timed relationship. A form of drive mechanism which may be employed is illustrated in FIGS. 9 – 9B to which reference is now made.

The main power source is a conventional electric motor 401 which through gear box 402 and coupling 403 drives main power shaft 404. Secured to power shaft 404 is a sprocket 406 which is connected by chain drive 407 to a sprocket 408 secured to a spindle 409 which drives the aforementioned star wheel 72, and also carries a gear 411 meshing with a bull gear 143' and with a second bull gear 313'. Bull gear 143' is secured to aforementioned shaft 143 which drives turret 28, and bull gear 313' is carried by a shaft 313 which drives turret 71. Gear 411 also meshes with a gear 412 carried by stub shaft 413 which carries a sprocket 414 connected by chain 416 which drives a sprocket 417 on shaft 418 which is connected to drive aforementioned screw conveyor 32.

The drive for main conveyor 31 is taken off bull gear 313' which meshes with gear 419 carried by a shaft 421 which drives star wheel 91 and also carries a sprocket 422 which through chain drive 423 drives the shaft 424 connected to drive main conveyor belt 31. The aforementioned star wheel 33 which conveys the bottles into turret 28 is driven from bull wheel 143' meshing with gear 427 secured to shaft 428 to which such star wheel is secured.

Bull gear 143' also serves to drive the aforementioned vacuum drum 23 and feed roller 18 for the continuous strip 14 of parent material. For such purpose, gear 143' engages gear 431 carried by a shaft 432. Shaft 432 carries sprocket 433 which is connected by chain drive 434 to aforementioned shaft 109 which drives vacuum drum 23. Also, shaft 432 carries a gear 437 in a space between gear 431 and sprocket 433 which through gear 438 on shaft 439 is connected to drive strip feed roller 18.

From the preceding description of the drive mechanism, it will be noted that the entire drive mechanism continuously operates and drives all the drivable components of the apparatus in synchronism. Suitable conventional control mechanism may be provided to interrupt the drive in case of a bottle 2 being missing from a support platform 29 in turret 28 therefor. For such purpose, as is schematically indicated in FIGS. 3 and 5, a light source 451 and photo-electric cell 452 may be provided which, should a bottle not be in place on a platform 29, automatically causes by conventional control means, the drive to slow to idling speed until bottle supply resumes. In this connection the normal speed of operation is up to about 300 bottles a minute, and the slow down speed about 20.

Likewise a light source 453 and photo-electric cell 454 (schematically indicated in FIGS. 3 and 8) are provided to detect when a capping sheet 6' is not fed on vacuum drum 23. If sheets are in place, light reflected therefrom will continuously maintain the drive through the photo-electric cell. However, if light is not reflected (when a sheet is not in place) the drive will be slowed down.

The principles of the invention described in detail above with reference to FIGS. 1 to 9B are also applicable to applying sleeves or labels to containers other than champagne bottles. The invention is applicable generally to the formation of cylindrical sleeves on the mandrels 27 by the means described above and illustrated in the drawings, for example in FIGS. 2 and 8; and stripping each sleeve or tube so formed off its mandrel onto the neck of a container as described above and as illustrated in the drawings, for example in FIGS. 2, 2A, 6, 6A and 6B.

Figure 10:
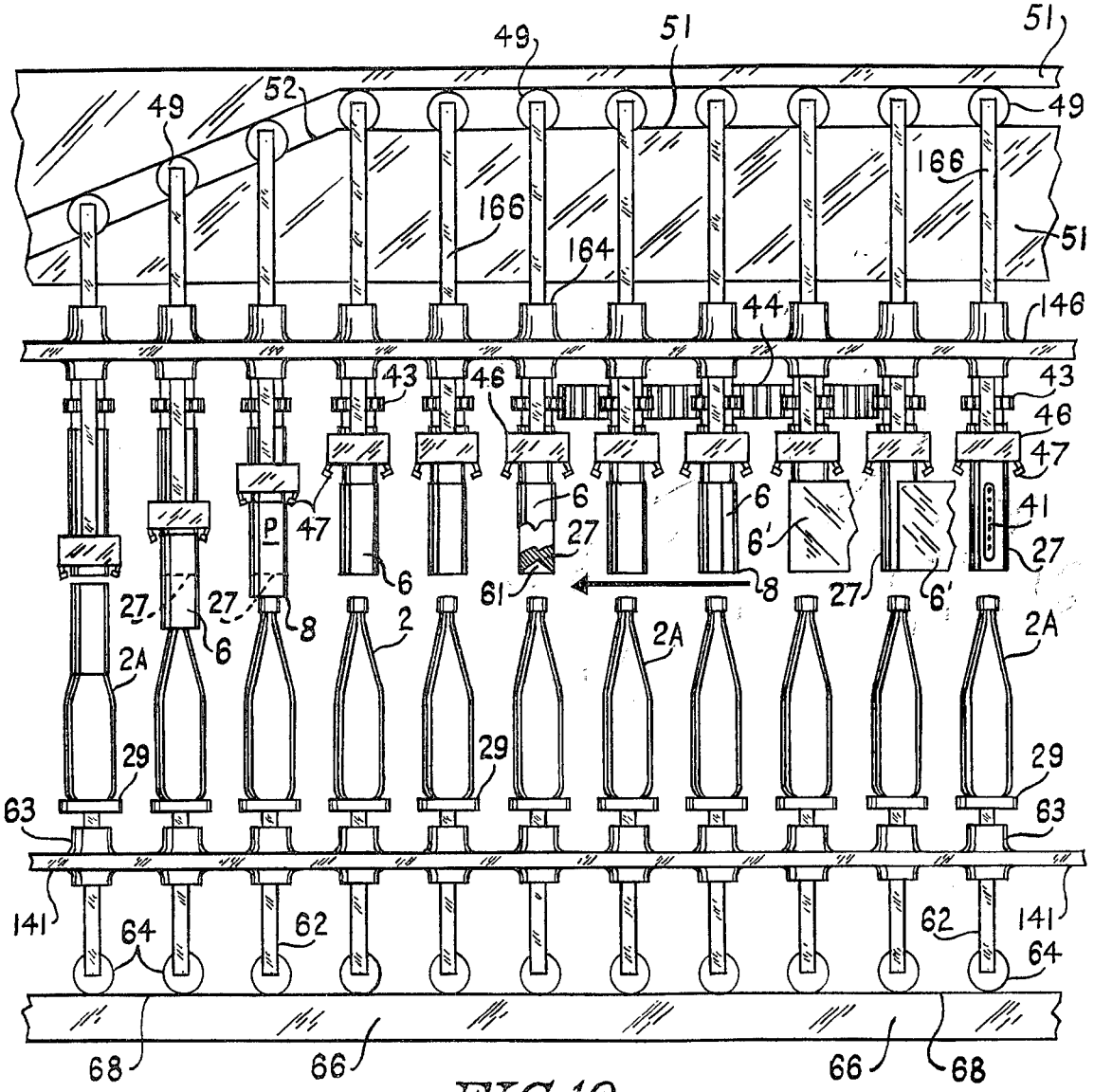
FIG. 10 is a view similar to FIG. 2 but terminating just prior to the position marked as P1 in FIG. 2 and showing containers other than champagne bottles which do not require a fold over of the sleeve material at the top.

Referring now to FIG. 10, which is a duplicate of FIG. 2 as far as the station or position just preceding P1, it will be seen that the bottles 2A have tapered necks but are not champagne bottles. The manner in which and the mechanism whereby the sleeves 6 are formed and are transferred from the mandrels 27 are identical to the manner and mechanism described above but, because the sleeves are heat shrunk onto the bottle necks (as described below with reference to FIG. 11), the creasing blades 48 are omitted together with the mechanism associated therewith, also all other apparatus employed to mechanically shape the sleeves after they have been stripped from the mandrels.

The bottles 2A are shown by way of example, and the sleeves 6 are shown as extending slightly above the tops of the bottles. Shorter sleeves which terminate below the bottle tops may be formed and applied. Also, bottles of other shapes such as, for example, catsup bottles, may be fitted with sleeves. Also, other containers having non-cylindrical configurations may be fitted with sleeves.

The web from which the sleeves are formed will be of a heat shrink material, for example polyethylene, polyvinyl chloride or polystyrene foam rather than a dead set material.

Figure 11:
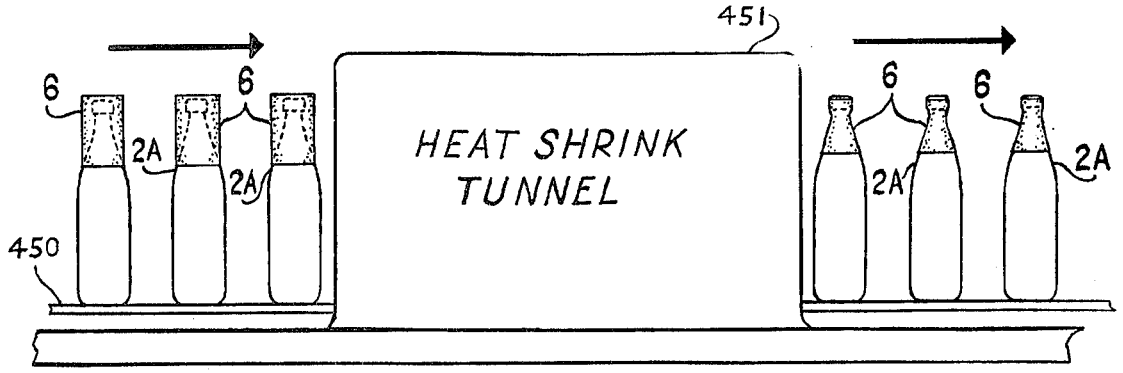
FIG. 11 is a diagramatic illustration of a heat shrink method of shaping the tubular sleeves to the shape of the neck of the container.

Referring now to FIG. 11, instead of employing mechanical shaping as in FIGS. 2B, 2C, 7, etc. the containers with tubular but as yet unshaped or unmolded sleeves are conveyed by any suitable means such as a continuous conveyor belt 450 into and through a heat shrink tunnel 451 with the result that the cylindrical sleeves are caused to shrink and to assume the tapered shape of the neck of the containers. Such shrinking will be longitudinal as well as lateral, therefore a sleeve which projects above the bottle top will shrink downwards as well as inwards.

It will, therefore, be apparent that novel method and apparatus have been provided for applying sleeves, labels and the like to the non-cylindrical portions, e.g. the necks, of containers such as the tapered necks of bottles; and that the method and apparatus are applicable to a wide variety of containers and to mechanical and heat shrink shaping operations.

I claim:

1. Apparatus for applying sleeves to the neck portions of containers each having a body portion and a neck portion tapering upwardly from the junction of the neck and body, the neck having a lesser diameter than the body, comprising:

(a) at least one cylindrical mandrel supported for rotation about its cylindrical axis and with one end free, said mandrel having an outside diameter substantially less than the diameter of the body portion of the container but sufficient to allow a sleeve formed by wrapping a sleeve material about the mandrel to fit over the neck of the container, (b) means for rotating the mandrel about its cylindrical axis, (c) means for applying one end of a segment of flexible sleeve material to the rotating mandrel, (d) means for then relesably adhering the segment to the rotating mandrel whereby the segment is rolled into a tube about the mandrel, (e) means for supporting a container in axial alignment with the mandrel with the upper end of its non-cylindrical portion close to but spaced from the free end of the mandrel, (f) said means (c), (d) and (e) being so arranged that said tube is spaced from the upper end of the container and so that the mandrel is at all times spaced from the upper end of the container, and (g) means for sliding the aforesaid tube off of the mandrel and onto the container.

2. The apparatus of claim 1 including means for conforming the tube to the non-cylindrical portion of the container.

3. The apparatus of claim 2 wherein said conforming means is in the form of mechanical instrumentalities acting mechanically to mold the tube to the shape of the non-cylindrical portion of the container.

4. The apparatus of claim 2 wherein said conforming means is in the form of heating apparatus and the tube is formed of a heat shrink material which is caused to shrink by the heating apparatus to conform to the shape of the non-cylindrical portion of the container.

5. The apparatus of claim 1 including means for continuously supplying a continuous web of sleeve material and for cutting such web into segments each of which is formed into a tube.

6. Apparatus for capping a beverage or the like bottle having a body, a neck of less diameter than the body, and a stopper, comprising a plurality of cylindrically shaped mandrels, each of a diameter less than the body of the bottles, mechanism for cutting individual cap forming sheet sections from a parent strip of material, means for gripping successive cap forming sections on successive mandrels while the respective mandrels are rotated to form cylindrically shaped sleeves thereon of a diameter less than the body of the bottle, mechanism for positioning the tops of a succession of bottles below the respective mandrels and in line with the lower ends of said respective mandrels, mechanism for slipping each thus formed sleeve downwardly from the mandrel onto the bottle with its lower end supported on the body of the bottle, the sleeve being of a length sufficient to extend above the top of the bottle, and mechanism operable after the sleeve is slipped onto the bottle for longitudinally creasing the top portion of the sleeve inwardly at spaced apart locations and for deforming the upper end of the sleeve inwardly over the top of the stopper to preform said sleeve partially to the shape of the neck.

7. Apparatus for capping a beverage or the like bottle having a neck and a stopper, comprising a cylindrically shaped mandrel, mechanism for rotating the mandrel about its axis, mechanism for gripping a cap forming sheet on said mandrel while it is rotated to form a sleeve thereon, mechanism for positioning the top of the bottle in line with an end of the mandrel, mechanism for slipping the thus formed sleeve from the mandrel onto the bottle, the sleeve being of a length sufficient to extend above the top of the bottle, and mechanism operable after the sleeve is slipped onto the bottle for longitudinally creasing the top portion of the sleeve inwardly at spaced apart locations and for deforming the upper end of the sleeve inwardly over the top of the stopper to preform said sleeve partially to the shape of the neck; the mechanism for gripping the cap forming strip on the mandrel comprising a longitudinally apertured portion of the mandrel, and means for applying suction thereto to grip an end portion of the strip which has adhesive on its outside face and to relieve the suction when the sleeve has been formed and the opposite end portion of the strip is adhered to said outside face of the strip; the mechanism for slipping the sleeve from the mandrel comprising a ring about the mandrel mounted for up and down movement axially of the mandrel and gripping fingers pivotally mounted on said ring operable to engage the upper end of the sleeve while on the mandrel when the ring is moved downwardly; the mechanism for creasing the top portion of the sleeve and for deforming the upper end of the sleeve comprising creasing blades movably mounted on said ring for in and out movement relative to said mandrel and operable to engage said sleeve in the downward position of the ring, and a cavity in the lower end of the mandrel which effects said deformation of said upper end of the sleeve; and mechanism for molding the partially preformed sleeve comprising spaced apart freely journalled rotatable rollers, means for rotating the bottle about its axis between said rollers with the sleeve thereon, means for pressing the rollers against the sleeve while the bottle is rotated, a mold cavity having a shape complementary to the stopper end of the bottle, and means for effecting engagement of the upper deformed end of the sleeve against the mold cavity.

8. The apparatus of claim 7 wherein said molding rollers are tilted from the vertical with respect to each other and exert a downward pull on the sleeve as the bottle is rotated.

9. The apparatus of claim 8 wherein the rollers are in sets of upper and lower rollers conformed to the taper of a tapered bottle neck.

10. The apparatus of claim 9 wherein rollers of each set are spaced apart and the sets are vertically staggered relative to each other to mold the sleeve over a wide area on the neck.

11. The apparatus of claim 10 wherein mounting means is provided for the rollers allowing limited universal movement thereof to enhance conformation of the rollers to the shape of the bottle neck.

12. The apparatus of claim 7 wherein after the sleeve has been preformed on the bottle neck, means is provided to convey the bottle onto a platform, means is provided to rotate the platform about its axis and simultaneously move it with the molding rollers which are initially spaced apart to receive the bottle therebetween, and means timed with the movement of the platform and bottle thereon is provided to engage the molding rollers against the sleeve on the bottle and subsequently effect disengagement therefrom to provide the initial space therebetween to receive another bottle after molding of the sleeve has been completed.

13. The apparatus of claim 12 wherein the respective molding rollers are carried by pivotally mounted bell cranks, resilient means is attached to the respective cranks to press the rollers against the preformed sleeve, and cam means including a cam follower on each crank and a cooperating fixed cam provides the initial spacing between said rollers.

14. The apparatus of claim 7 comprising additionally a platform for supporting a bottle thereon with the bottle under the mandrel cavity, means to move the platform abd mandrel simultaneously in the same direction, and means for elevating the platform and inserting the top end of the sleeve into the mold cavity while the platform and mandrel are thus moved.

15. In apparatus for capping a beverage or the like bottle having a generally conically shaped neck and a stopper, mechanism for preforming a sleeve of capping material over the neck of the bottle and over the stopper comprising a mandrel, means for forming said sleeve on the mandrel, a cavity in the lower end of the mandrel, a ring about the mandrel mounted for up and down movement axially of the mandrel, sleeve gripping fingers movably mounted on the ring, means for actuating said fingers to grip the sleeve and slip it off the mandrel over the neck of the bottle when the ring is moved downwardly, the sleeve being of a length sufficient to extend above the top of the bottle, creasing blades movably mounted on said ring for in and out movement relative to the mandrel operable to engage said sleeve in a downward position of the ring, means for urging the blades inwardly, cam means on the blades cooperable with said mandrel for allowing inward and outward movement of the blades, and means for effecting relative axial movement between the top end of the bottle and the mandrel cavity to press the top end of the sleeve in the mandrel cavity.

16. The apparatus of claim 15 wherein the creasing blades are pivotally mounted adjacent their lower ends, and each blade comprises an upwardly extending inner creasing edge, an outwardly and upwardly extending cam edge engageable with a lower part of the mandrel for allowing inward movement of the creasing edge, and an intermediate can abutment between the creasing edge and the cam edge for engaging the outer face of the mandrel as the ring is moved axially thereof.

17. The apparatus of claim 16 wherein the means for urging the creasing blades inwardly is resilient means engaging the outer edges of the creasing blades.

18. The apparatus of claim 17 wherein the resilient means is a garter spring about the upper end portion of the creasing blades.

19. Apparatus for continuously forming bottle capping sheets for stoppered beverage bottles or the like having tapered necks and for continuously capping a successive of said bottles with a succession of said sheets comprising:

(a) a capping sheet forming section, (b) a section for forming cylindrical sleeves and preforming them to conform partially to the shape of the bottle necks and over their stoppers, and (c) a section for molding successive sleeves to the shape of the necks and stopper ends of the bottles;

said capping sheet forming section (a) comprising means for continuously feeding a parent strip of material from which the capping sheet can be severed, means for severing successive capping sheets from said parent strip, a vacuum drum having means for gripping successive capping sheets thus severed and releasing them to the sleeve forming and preforming section (b), and means for applying adhesive to the outer face of each successive capping sheet;

the sleeve forming and shape-preforming section (b) comprising a succession of cylindrically shaped mandrels about which the sleeves are formed, each having a longitudinally apertured portion, means for continuously moving the mandrels adjacent the vacuum drum, means for applying suction to the mandrels to grip the leading edge of successive capping sheets to transfer them from the vacuum drum and to relieve suction on the mandrels when the sleeves have been formed thereon, means for rotating the mandrels about their axes to wrap the capping sheets therearound and form said sleeves on the respective mandrels, means for conveying and positioning a succession of bottles with their tops in line with the ends of successive mandrels, a support ring about each mandrel and means for moving each ring up and down axially of the mandrel, gripping fingers pivotally mounted on each ring operable to engage the upper end of the sleeve thereon and to slip the sleeve over the neck of the bottle in a downward position of the ring, creasing blades movably mounted on each ring for in and out movement relative to the associated mandrel operable to engage the sleeve in such downward position of the ring, a deforming cavity in the lower end of each mandrel shaped to effect inward deformation of the respective sleeves over the stoppered end of the respective bottles, and means for effecting relative movement between each mandrel and alined bottle to bring the deformed upper end of the sleeve in engagement with said deforming cavity;

and said molding section (c) comprising conveying and positioning means for receiving a succession of bottles with preformed caps thereon from transfer means between said sleeve forming and shape preforming section (b) and said capping sheet forming section (a), sets of spaced apart freely journalled rotatable rollers, means for mounting and moving such sets in alinement with the bottles on said conveying and positioning means of said molding section (c), means for rotating successive bottles about their respective axes, means for pressing the sets of rollers against the sleeves on the respective bottles as they are rotated about their axes, a plurality of mold cavities each having a shape complementary to the stopper end of the respective bottles, means for mounting and conveying the mold cavities in alinement with the tops of such bottles, and means for effecting relative movement between each mold cavity and alined bottle to effect engagement of the stoppered end and the mold cavity as the bottle is rotated about its axis.

20. The apparatus of claim 19 wherein means is provided to apply yieldable pressure to the sleeve sheets on the mandrels as the mandrels are rotated.

21. The apparatus of claim 20 wherein the means for rotating the mandrels comprises a gear carried by each mandrel for rotation therewith and a rack engaging such gears, and the means for applying said yieldable pressure comprises brush structure engaging the sleeve sheets on the mandrels.

22. The apparatus of claim 19 wherein the sleeve preforming and shape preforming section (b) further comprises a rotary turret, the mandrels are carried at a fixed elevation by said turret, the support rings are actuated for up and down movement by cam mechanism on said turret, the conveying and positioning means for said bottles are spaced apart platforms carried by and slidably mounted on said turrent for up and down movement, and cam mechanism carried by said turret is provided to intermittently elevate said platforms to bring the deformed ends of the sleeves into engagement with the respective deforming cavities in said mandrels and then lower said platforms;

and wherein the molding section (c) further comprises a rotary turrent, its mold cavities and associated sets of rollers are carried by said turret, the bottle positioning and conveying means comprises spaced apart platforms carried by and slidably mounted on said turret for up and down movement, and cam mechanism carried by said turrent is provided to intermittently elevate the latter platforms to bring the deformed upper ends of the caps into engagement with the respective mold cavities, and clamp the respective bottles between a mold cavity and a platform as the bottle is rotated.

23. A method of applying sleeves to non-cylindrical portions of containers which comprises the following steps:

(a) presenting in succession segments of sleeve material (b) applying one end of each sleeve segment to a rotating cylindrical mandrel having one end free, detachably adhering such end to the mandrel and wrapping the segment around the rotating mandrel to form a tubular sleeve (c) supporting a container having a non-cylindrical portion in axial alignment with the mandrel with its upper end close to the free end of the mandrel, the mandrel bearing a tubular sleeve formed in step (b) and (d) slipping each tubular sleeve off of its mandrel and onto a container.

24. The method of claim 23 including the step of conforming the tubular sleeve to the shape of the non-cylindrical portion.

25. The method of claim 24 wherein the sleeve material is a dead set material and the conforming step is carried out mechanically.

26. The method of claim 2 wherein the sleeve material is a heat shrink material and the conforming step is carried out by heat shrinking.

27. The method of claim 24 wherein the sleeve material is supplied in the form of a continuous web and is cut into segments.

28. The method of capping a beverage bottle or the like having a tapered neck and a stopper, which comprises providing a continuous strip of material as a sleeve supply source, continuously conveying a succession of such bottles to a sleeve forming station, cutting a succession of individual sleeve sections from said strip, providing a succession of cylindrical mandrels each rotatable about its axis and of a diameter less than the body of the bottle whereby a preformed sleeve section wrapped about a mandrel can be supported with its lower edge engaging the body of the bottle, transferring each successive sleeve section to a cylindrical mandrel, rotating each mandrel to wrap the sleeve section thereon and form a preformed cylindrical sleeve, bringing each successive bottle in line with a mandrel below the lower edge of the sleeve formed on said mandrel, sliding the preformed cylindrical sleeve off of the mandrel directly over the neck of the bottle with its lower edge engaging the body of the bottle whereby said sleeve is supported on the body of the bottle, partially preforming each sleeve to the shape of the neck and over the stopper, and molding such preformed sleeve under pressure to conform to the shape of the neck and the stopper.

29. The method of capping a beverage or the like bottle having a tapered neck and a stopper, with material capable of assuming a dead set condition when creased or folded, which comprises providing a sleeve of said material, placing said sleeve over the bottle neck, partially preforming the sleeve to the shape of the neck and over the stopper, and molding the preformed sleeve under pressure to conform to the neck and the stopper; said method further comprising providing a continuous strip of material as a sleeve supply source, continuously conveying a succession of such bottles to a sleeve forming station, continuously feeding said strip to said station, cutting a succession of individual sleeve sections from said strip, applying adhesive to the trailing edge portion of the outer face of each successive sleeve section, providing a succession of cylindrical mandrels rotatable about their axes, transferring each adhesive applied section to a mandrel, rotating each mandrel and wrapping the sleeve section about the mandrel to form a sleeve thereon, bringing each successive bottle in line with a mandrel, and tranferring the sleeve formed on the mandrel over the neck of the bottle.

30. The method of claim 29 wherein a vaccuum drum is provided to convey successively cut sleeve sections and release them to the successive mandrels, suction is applied the successive mandrels to retain the successive sleeve sections thereon until they are formed, and release of the suction of the sleeves is effected to allow transfer of the formed sleeves over the bottle necks.

31. The method of claim 29 further comprising bonding together opposite edge portions of the successive sleeve sections on the successive mandrels by applying yieldable pressure to the sleeve sections on the mandrels as the mandrels are rotated.

32. The method of claim 30 wherein transfer of the successively formed sleeves over the bottles necks is effected after release of said suction by gripping the successive sleeves and slipping them off of the mandrels.

33. The method of claim 29 wherein the successive sleeves are each formed of a length sufficient to extend above the stopper end of the bottle when the lower edge of the sleeve is supported on the body of the bottle, the partial deformation of the sleeve is effected by longitudinally creasing such extending portion inwardly at spaced apart locations about the circumference of the sleeve and by shaping the top end portion of the sleeve conically over the stopper.

34. The method of claim 33 wherein molding of the thus preformed sleeve is effected by providing spaced apart rollers freely rotatable about upright axes tilted with respect to each other, rotating the bottle about its axis with the sleeve thereon while simultaneously imparting yieldable pressure to the rollers against the sleeve and pressing the conically shaped end portion of the sleeve against the top of the stopper.

* * * * *